US010196812B1

(12) United States Patent
Duffy et al.

(10) Patent No.: US 10,196,812 B1
(45) Date of Patent: Feb. 5, 2019

(54) WEEP SCREED

(71) Applicants: Frank L. Duffy, Downingtown, PA (US); Ronald L. Christopher, Jr., Springfield, PA (US)

(72) Inventors: Frank L. Duffy, Downingtown, PA (US); Ronald L. Christopher, Jr., Springfield, PA (US)

( * ) Notice: Subject to any disclaimer, the term of this patent is extended or adjusted under 35 U.S.C. 154(b) by 0 days.

(21) Appl. No.: 14/869,524

(22) Filed: Sep. 29, 2015

(51) Int. Cl.
*E04B 1/70* (2006.01)

(52) U.S. Cl.
CPC ..... *E04B 1/7038* (2013.01); *E04B 1/7076* (2013.01)

(58) Field of Classification Search
CPC ..... E04B 1/7038; E04B 1/7076; E04B 1/765; E04F 13/06; E04F 2013/065
USPC ..... 52/61, 302.1, 302.6, 302.3
See application file for complete search history.

(56) References Cited

U.S. PATENT DOCUMENTS 2,645,824 A * 7/1953 Titsworth ..... E04B 1/7069 220/592.01
3,314,201 A * 4/1967 Riegelman ..... E06B 7/14 49/408
3,509,674 A * 5/1970 Birum, Jr. ..... E04B 2/967 52/302.1
3,638,372 A * 2/1972 Rosenthal ..... E06B 7/14 49/476.1
4,984,402 A * 1/1991 Davies ..... E06B 3/22 52/204.593
5,519,969 A * 5/1996 Golba ..... E04D 13/1407 52/58
5,946,870 A * 9/1999 Bifano ..... E04B 1/765 52/254
5,970,671 A * 10/1999 Bifano ..... E04B 1/765 428/603
6,119,429 A * 9/2000 Bifano ..... E04B 1/765 52/101
6,134,847 A * 10/2000 Bifano ..... E04B 1/765 52/101
6,293,064 B1 * 9/2001 Larson ..... E04B 1/762 52/209
6,298,609 B1 * 10/2001 Bifano ..... E04B 1/765 52/101
6,385,932 B1 * 5/2002 Melchiori ..... E04F 13/06 52/302.3
7,634,883 B1 * 12/2009 Larson ..... E04F 13/06 52/393
8,578,660 B2 * 11/2013 Nolan ..... E04F 19/045 52/302.6

(Continued)

*Primary Examiner* — Brent W Herring
(74) *Attorney, Agent, or Firm* — John. F. A. Farley, III; Frank J. Bonini, Jr.; Harding, Earley, Follmer & Frailey, P.C.

(57) ABSTRACT

A convective weep screed for draining water that penetrates exterior cladding of an exterior wall of a building away from the building and for removing moisture located in the space between the weather resistant barrier of the wall and the exterior cladding and for providing ventilation to the space between the weather resistant barrier and the exterior cladding. The weep screed provides a pathway to the space between the weather resistant barrier and the exterior cladding to permit water/moisture/moisture vapor that collects there to drain therefrom and to permit air to gain access to said space, thereby providing an uninterrupted pathway for air to ventilate and dry said space.

29 Claims, 25 Drawing Sheets

(56) References Cited

U.S. PATENT DOCUMENTS

| | | | | |
|---|---|---|---|---|
| 8,919,062 | B1 * | 12/2014 | Viness | E04F 13/04 52/220.5 |
| 9,200,455 | B2 * | 12/2015 | Preston | E04F 13/06 |
| 9,238,897 | B2 * | 1/2016 | Nolan | E04F 19/045 |
| 9,499,981 | B2 * | 11/2016 | Grisolia | A47K 3/008 |
| 2004/0216414 | A1 * | 11/2004 | Dickinson | E04B 1/7046 52/506.01 |
| 2007/0062137 | A1 * | 3/2007 | Maylon | E04F 13/06 52/367 |
| 2015/0027074 | A1 * | 1/2015 | Preston | E04F 13/06 52/302.1 |
| 2016/0024788 | A1 * | 1/2016 | Grisolia | A47K 3/008 52/302.1 |
| 2016/0069071 | A1 * | 3/2016 | Remmele | E04F 13/068 52/232 |
| 2017/0016226 | A1 * | 1/2017 | Grisolia | A47K 3/008 |

* cited by examiner

WEEP SCREED

FIELD OF THE INVENTION

This invention relates to weep screed for draining water that penetrates exterior cladding, such as stucco, of an exterior wall of a building away from the building, and more particularly is concerned with weep screed for draining water that penetrates exterior cladding of an exterior wall of a building away from the building and for removing moisture located in the space between the weather resistant barrier (such as Tyvek), which is wrapped onto the backing wall of the exterior wall, and the exterior cladding, and for providing ventilation to the space between the weather resistant barrier (such as Tyvek) and the exterior cladding.

BACKGROUND OF THE INVENTION

In the building construction art, it has been a requirement under the Uniform Building Code since 1973 to use a weep screed at the base (that is, the foundation plate line) of exterior walls of a building to help support exterior cladding (e.g., stucco) of the exterior walls, to provide a water barrier between the exterior walls and the foundation of the building, and to direct water that penetrates the exterior cladding and drains downwardly to the ground flange of the weep screed away from the building.

Since the late 1970's and early 1980's, due to climbing energy costs, buildings have been designed to be tighter so as to minimize leakage of air and energy. That is, to obtain higher thermal energy efficiencies, exterior building walls have been provided with vapor barriers (e.g., house wraps such as Tyvek) to minimize leakage of air and energy. Unfortunately, these energy saving measures inhibit the ability of the exterior walls to breath and ultimately dry. Failure of an exterior wall to property dry may lead to water damage to and rotting of the interior of the exterior wall, as well as the formation of mold.

SUMMARY OF THE INVENTION

It is an object of the invention to enhance drying capability of an exterior wall of a building.

It is another object of the invention to provide a weep screed that not only helps support the exterior cladding (e.g., stucco) of an exterior wall of a building, provides a water barrier between the exterior wall and the foundation of the building, and directs water that penetrates the exterior cladding and drains downwardly in the exterior cladding to the ground flange of the weep screed to flow away from the building, but also permits moisture located between the weather resistant barrier (such as Tyvek), which is wrapped onto the backing wall of the exterior wall, and the exterior cladding to drain from the space between the weather resistant barrier (such as Tyvek) and the exterior cladding and be directed away from the building, and provides ventilation to the space between the weather resistant barrier (such as Tyvek) and the exterior cladding, thereby permitting an exterior wall to dry.

Still another object of the invention is to provide a weep screed that may be mounted at various locations on an exterior wall of a building including at the base of the wall or above a frame or jamb for a window or door, that helps support the exterior cladding (e.g., stucco) of an exterior wall of a building, that directs water that penetrates the exterior cladding and drains downwardly in the exterior cladding to the ground flange of the weep screed to flow away from the building, that permits moisture located between the weather resistant barrier (such as Tyvek), which is wrapped onto the backing wall of the exterior wall, and the exterior cladding to drain from the space between the weather resistant barrier (such as Tyvek) and the exterior cladding and be directed away from the building, and provides ventilation to the space between the weather resistant barrier (such as Tyvek) and the exterior cladding, thereby permitting an exterior wall to dry.

A further object of the invention is to provide a weep screed that functions as a top of wall termination vent that directs water that falls onto its ground flange away from the exterior wall and that provides a drainage path for moisture vapor located between weather resistant barrier (such as Tyvek), that is wrapped onto the backing wall, and the exterior cladding of the exterior wall and that provides ventilation to the space between weather resistant barrier (such as Tyvek) and the exterior cladding of the exterior wall, thereby permitting an exterior wall to dry.

These and other objects are provided by our invention which is set out below.

DETAILED DESCRIPTION

Figure 1:
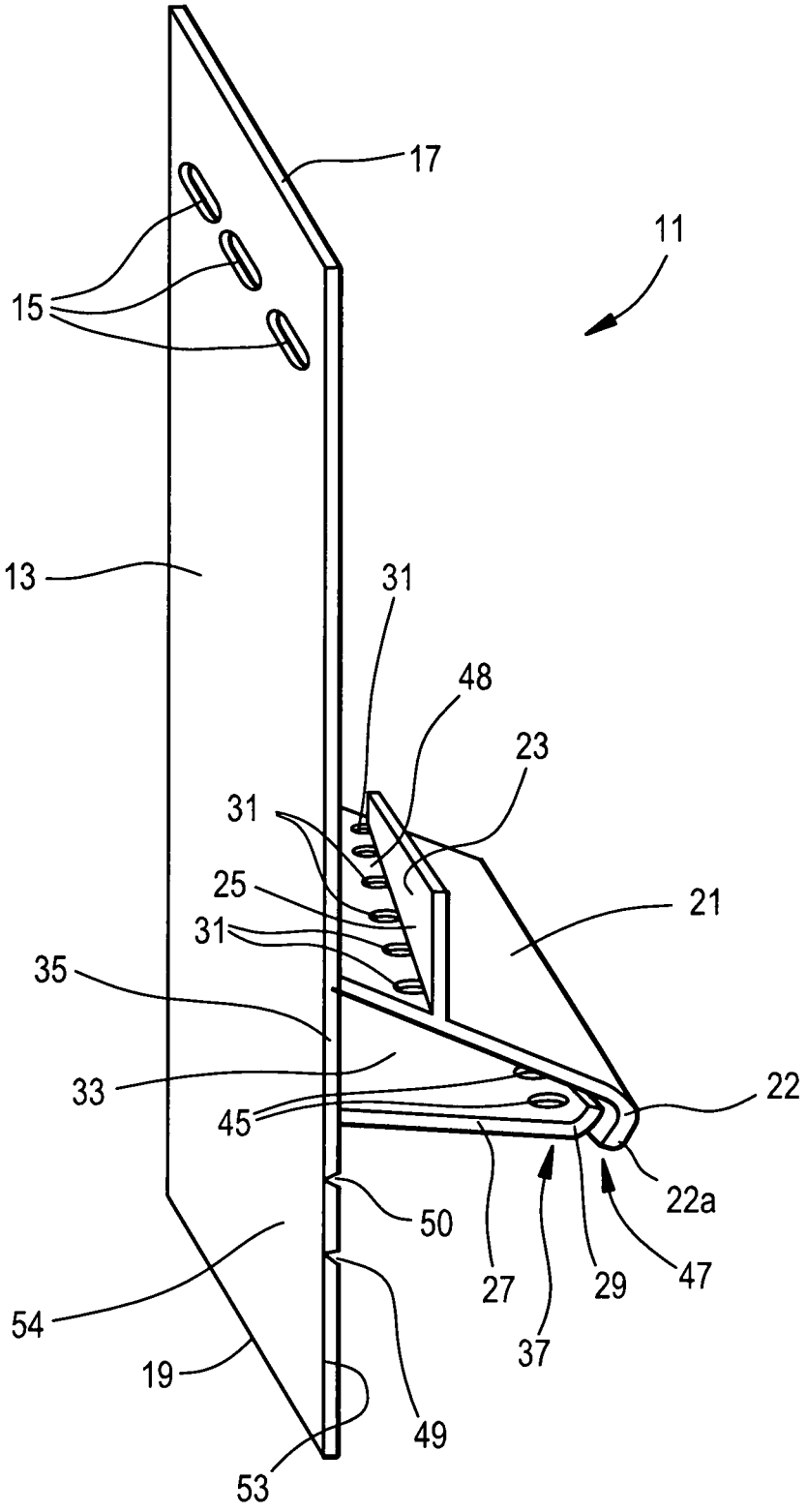
FIG. 1 is a view in perspective of a weep screed constructed in accordance with the invention.
Figure 2:
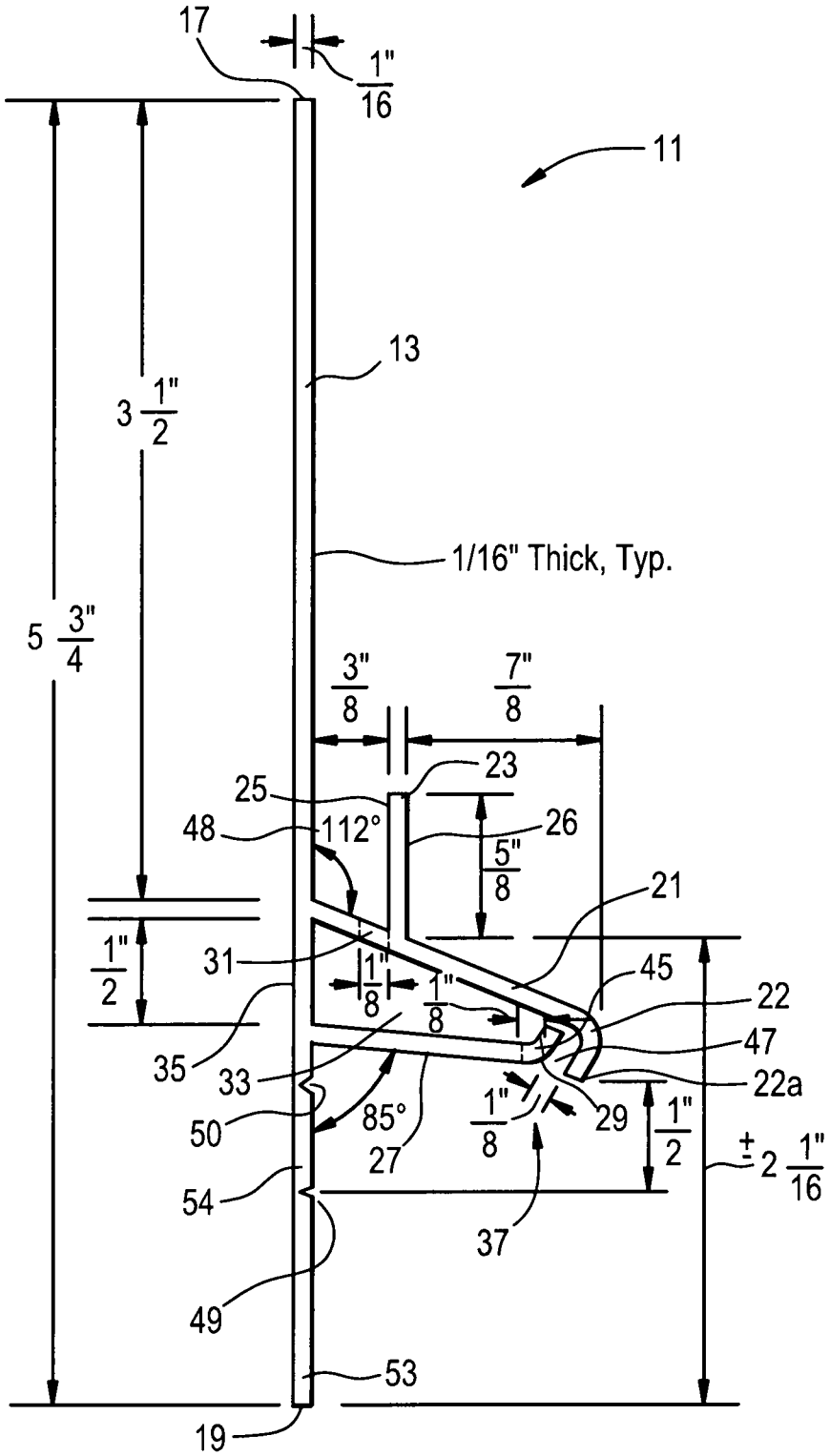
FIG. 2 is a view in side elevation of the weep screed shown in FIG. 1.

Turning now to the drawings, there is shown in FIGS. 1-5 a first embodiment of the inventive weep screed 11. Preferably, the inventive weep screed 11 is designed to be mounted on the bottom of an exterior wall of a building at foundation level to help support the exterior cladding (e.g., stucco) of the exterior wall resting on the weep screed 11, provide a water barrier between the exterior wall and the foundation of the building, direct water that penetrates the exterior cladding from outside the building and drains downwardly in the exterior cladding, or between the exterior cladding and a weather resistant barrier (such as Tyvek) wrapped onto the backing wall of the exterior wall, to the weep screed 11 to flow downwardly along the primary ground flange 21 to the drip line 22*a* and then fall away from the building, permit moisture located between the weather resistant barrier (such as Tyvek), that is wrapped onto the backing wall of the exterior wall, and the exterior cladding to drain from the space between the weather resistant barrier (such as Tyvek) and the exterior cladding and be directed away from the building, and provide ventilation to the space between the weather resistant barrier (such as Tyvek) and the exterior cladding, thereby permitting the exterior wall to dry.

The weep screed 11 has a vertical attachment flange 13 (which also may be referred to as a nailing flange or a vertical member or a vertical attachment member or a vertical attachment panel) which is used to attach the weep screed 11 to a wall, preferably using nails or staples which extend through the nailing holes 15 (which also may be referred to as nailing punch-outs or nailing gauge or nailers) into the wall to hold the vertical attachment flange 13 to the wall. The vertical attachment flange 13 has an upper end 17 and a lower end 19.

The primary ground flange 21 (which also may be referred to as a ground, or ground flange, or outwardly protruding member, or primary weathering member, or primary member) preferably extends outwardly at an obtuse angle from the vertical attachment flange 13. Preferably, the obtuse angle may be any angle greater than 90 degrees and less than 180 degrees, and preferably is 112 degrees downwardly from the vertical attachment flange 13. Preferably, the obtuse angle is such that the primary ground flange 21 projects downwardly at an angle sufficiently downwardly and outwardly to provide direction to water, such as rain, that has penetrated into the wall and/or has been absorbed by the wall, and has drained downwardly to the primary ground flange 21, so that such water flows along the primary ground flange 21 away from the building. Preferably, the primary ground flange 21 has a downwardly extending outer end portion 22 that forms a drip line 22*a*, from which the rain/water flowing along the primary ground flange 21 falls away from the building.

A retaining flange 23 (which also may be referred to as a drainage plane gauge, or starter retaining flange, or standoff flange) preferably, but optionally, is formed on the primary ground flange 21, and extends upwardly and in a plane parallel to or substantially parallel to the vertical attachment flange 13. The retaining flange 23 has an inside surface 25 that faces the vertical attachment flange 13 and an outside surface 26 that faces away from the vertical attachment flange 13. The retaining flange 23 creates a recess 48 between itself and the vertical attachment flange 13.

A secondary ground flange 27 (which also may be referred to as a secondary member with lower ground, or a secondary weathering member, or a lower ground) is formed on the vertical attachment flange 13 and is positioned on the vertical attachment flange 13 between the primary ground flange 21 and the lower end 19 of the vertical attachment flange 13. The secondary ground flange 27 extends outwardly from the vertical attachment flange 13 preferably at an obtuse angle from the vertical attachment flange 13. Preferably, the obtuse angle may be any angle greater than 90 degrees and less than 180 degrees, and preferably is 95 degrees downwardly from the vertical attachment flange 13. Preferably, the obtuse angle is such that the secondary ground flange 27 projects downwardly at an angle sufficiently downwardly and outwardly to provide direction to water, such as rain, that has penetrated into the wall and/or has been absorbed by the wall, and has drained downwardly to the primary ground flange 21, so that such water flows along the secondary ground flange 27 away from the building. The secondary ground flange 27 has an outer end portion 29.

The primary ground flange 21 has at least one opening 31 formed therein and extending therethrough located in a portion of the primary ground flange 21 between the vertical attachment flange 13 and the retaining flange 23. Preferably, a row of openings 31 is provided along the entire length of the primary ground flange 21 of the weep screed 11, with each opening 31 being equally spaced from the adjacent opening 31.

A chamber 33 is defined by the primary ground flange 21, the secondary ground flange 27, and the portion 35 of the vertical attachment flange 13 that extends between the primary ground flange 21 and the secondary ground flange 27.

The chamber 33 has at least one entrance/exit port 37 through which air may enter to provide ventilation to the space 39 between the weather resistant barrier 41 (such as Tyvek), which is wrapped onto the backing wall 57, and the exterior cladding 43, and from which moisture and moisture vapor that has drained into the chamber 33 from the space 39 between the weather resistant barrier 41 (such as Tyvek), which is wrapped onto the backing wall 57, and the exterior cladding 43 via the opening(s) 31 may drain from the chamber 33 away from the wall and the building. In the embodiment of the invention shown in FIGS. 1-5, the entrance/exit port 37 includes at least one opening 45 formed in the outer end portion 29 of the secondary ground flange 27, and preferably includes a row of openings 45 that extends across the entire length of the outer end portion 29 of the secondary ground flange 27. The secondary ground flange 27 projects downwardly to the opening(s) 45 formed therein and extending therethrough, the opening(s) 45 being at or near the lowest point on the secondary ground flange 27, to direct moisture that has drained into the cavity 33 via the opening(s) 31 to move to and drain from the opening(s) 45 to outside of the wall away from the building. After the opening(s) 45 in the outer end portion 29 of the secondary ground flange 27, the outer end portion 29 projects upwardly towards but is preferably spaced apart from the primary ground flange 21.

In the embodiment of the invention shown in FIGS. 1-5, the at least one entrance/exit port 37 also includes a gap 47 between the outer end portion 22 of the primary ground flange 21 and the outer end portion 29 of the secondary ground flange 27.

In general, the invention includes means for providing a drainage path for moisture located in the space 39 between the weather resistant barrier 41 (such as Tyvek), which is wrapped onto the backing wall 57 of the wall, and the exterior cladding 43 of the wall to drain from between the weather resistant barrier 41 (such as Tyvek) and the exterior cladding 43 to outside the exterior wall away from the building, and for providing ventilation to the space 39 between the weather resistant barrier 41 (such as Tyvek), which is wrapped onto the backing wall 57, and the exterior cladding 43. In the embodiment of the invention shown in FIGS. 1-5, as well as in the embodiment of the invention shown in FIG. 8, such means comprises the recess 48 leading to the opening(s) 31, the opening(s) 31 formed in and extending through the primary ground flange 21, the interior of the chamber 33, the opening(s) 45 formed in and extending through the outer end portion 29 of the secondary ground flange 27, and the gap 47 between the outer end portion 22 of the primary ground flange 21 and the outer end portion 29 of the secondary ground flange 27.

The retaining flange 23 protects the opening(s) 31 from being blocked or clogged by the exterior cladding 43 (e.g., stucco) since the exterior cladding 43 (e.g., stucco) is positioned adjacent to the outside surface 26 of the retaining flange 23. The recess 48 between the retaining flange 23 and the vertical attachment flange 13 is designed to hold the lower end portion of a drainage mat 61 and/or starting strips 73. Also, since the exterior cladding 43 (e.g., stucco) is positioned adjacent to the outside surface 26 of the retaining flange 23, the space 39 between the weather resistant barrier 41 (such as Tyvek), which is wrapped onto the backing wall 57, and the exterior cladding 43 extends upwardly from the recess 48. This space 39 may be empty, but preferably contains a porous drainage mat 61 and/or starter strips 73.

Preferably, but optionally, a groove 49 is formed along the length of the vertical attachment flange 13 in a portion 51 of the vertical attachment flange 13 below the secondary ground flange 27. The groove 49 is provided with a sufficient depth for permitting the portion 53 of the vertical attachment flange 13 located below the groove 49 to be broken off along the grove 49. This feature permits the height of the weep screed 11 to be easily adjusted when appropriate to meet spacing requirements.

Also, preferably, but optionally, at least one additional groove 50 may be formed along the length of the vertical attachment flange 13 in a portion 51 of the vertical attachment flange 13 below the secondary ground flange 27. The groove 50 is provided with a sufficient depth for permitting the portion 54 of the vertical attachment flange 13 located below the groove 50 to be broken off along the grove 50. This feature permits the height of the weep screed 11 to be easily adjusted when appropriate to meet spacing requirements.

Figure 3:
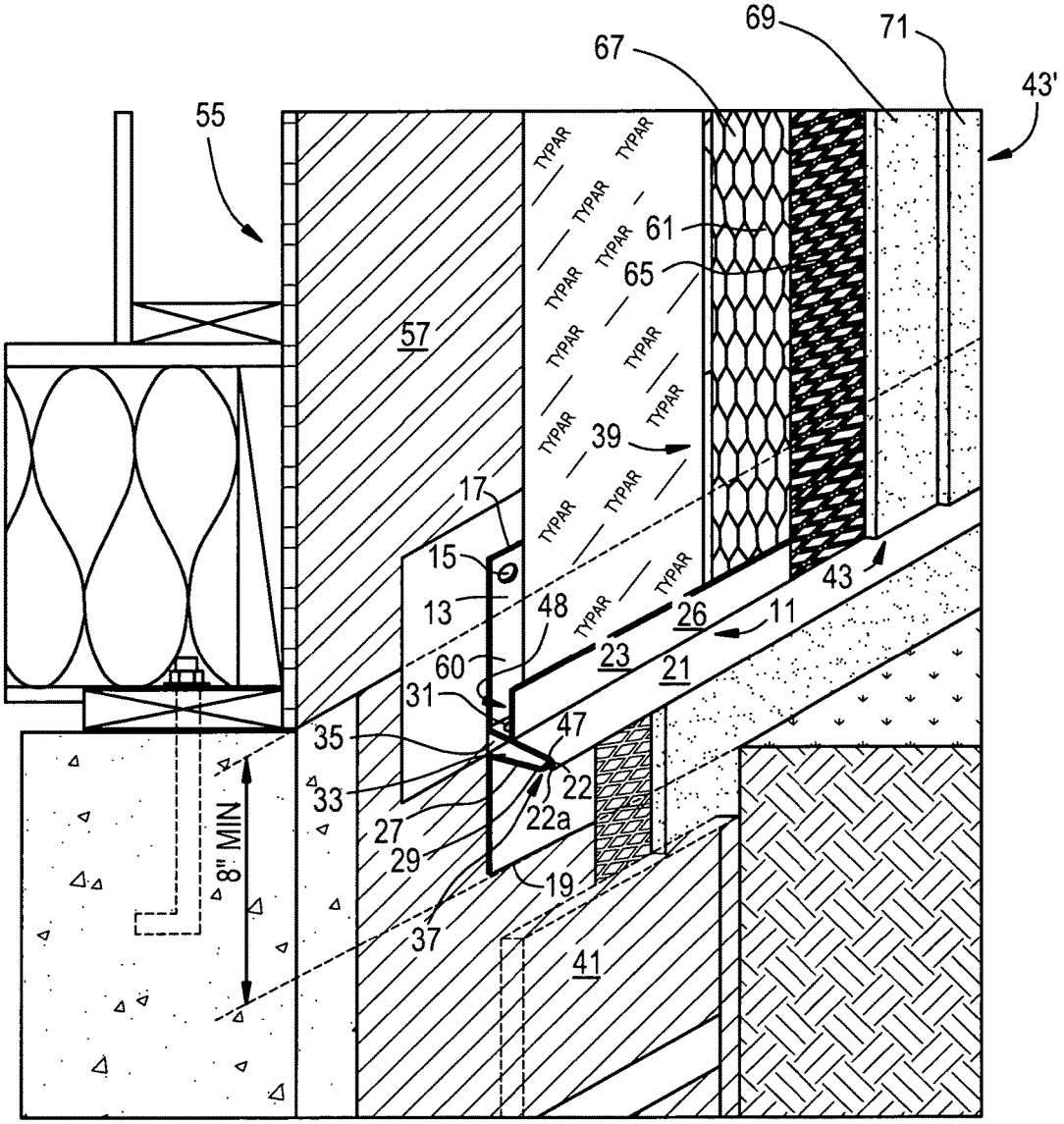
FIG. 3 is a view in perspective of an inventive wall that includes the weep screed shown in FIGS. 1 and 2. Various portions have been cut away to illustrate details of the inventive wall.
Figure 4:
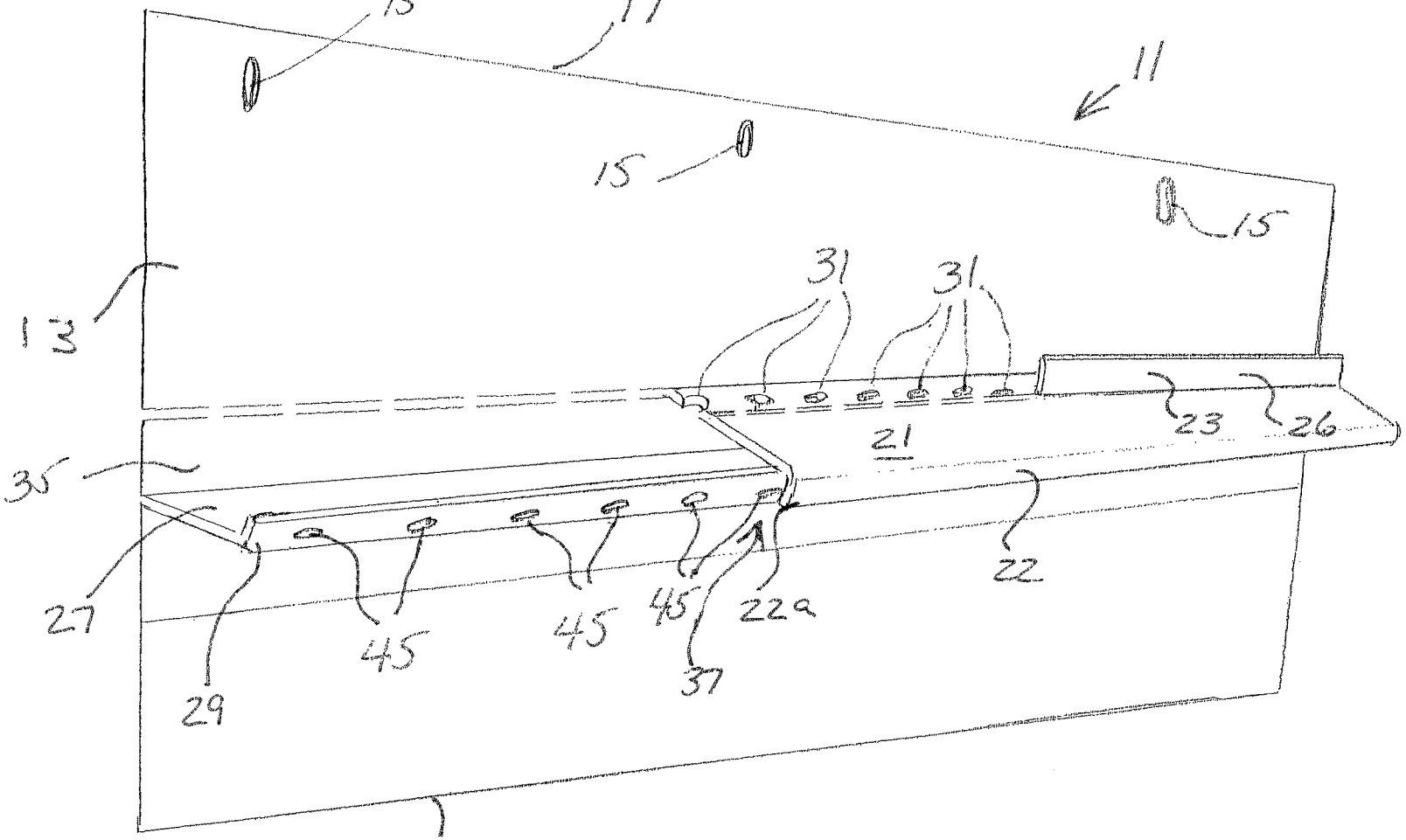
FIG. 4 is a view in perspective of the inventive weep screed shown in FIGS. 1-3, with various portions being cut away to illustrate details of the inventive structure thereof.
Figure 5:
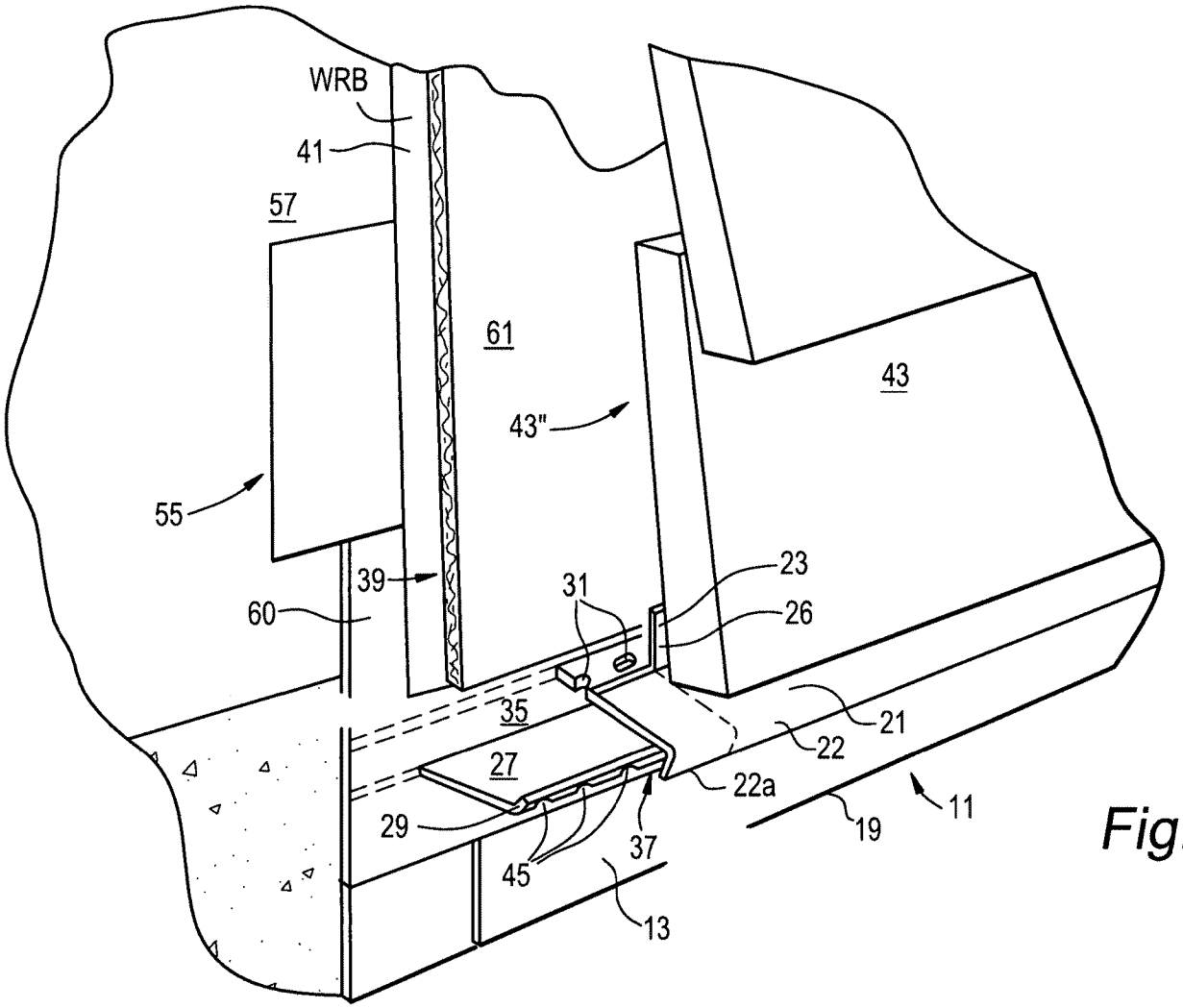
FIG. 5 is a view in perspective of an alternative embodiment of the inventive wall that includes the weep screed shown in FIGS. 1 and 2, in which the exterior cladding comprises siding. Various portions have been cut away to illustrate details of the inventive wall.

The invention also includes a wall 55 having the inventive weep screed 11 mounted thereon as shown in FIGS. 3 and 5. Preferably, the wall 55 has a backing wall 57 (e.g., plywood sheeting, or studded wall, or studded wall with sheathing), a weep screed 11 mounted on the backing wall 57 at the bottom portion of the wall 55, a weather resistant barrier 41 (which also is known as a water resistant barrier or WRB or a vapor barrier) positioned over the backing wall 57 and over the portion 60 of the vertical attachment flange 13 located above the primary ground flange 21, a drainage mat 61 positioned against the weather resistant barrier 41 including a portion of the drainage mat 61 that is received in the recess 48 between the vertical attachment flange 13 and the retaining flange 23, and exterior cladding 43 positioned over the drainage mat 61 above the upper end of the retaining flange 23 and over the outside surface 26 of the retaining flange 23.

Illustrative examples of the exterior cladding 43 include stucco, fiber cement siding, cultured stone, veneer stone, brick veneer, wood siding, or vinyl siding.

FIG. 3 shows an illustrative example of the inventive wall 55, in which the exterior cladding 43 comprises a stucco structure 43'. As may be seen in FIG. 3, the construction of the stucco structure 43' usually occurs in layers. A wire mesh layer 65 of galvanized wire is usually anchored to the backing wall 57 over the outside surface 67 of the drainage mat 61. Scratch coats 69 of plaster or stucco and finish coats 71 of plaster or stucco are then usually applied to the wire mesh layer 65.

FIG. 5 shows another illustrative example of the inventive wall 55, in which the exterior cladding 43 comprises siding 43". As may be seen from FIG. 5, in addition to a portion of the drainage mat 61 being positioned in the recess 48 between the vertical attachment flange 13 and the retaining flange 23, starter strips 73 (not shown) preferably are provided to assist in securing the siding 43" to the wall 55 and to assist in creating the air space 39 between the weather resistant barrier 41 (such as Tyvek), which preferably is wrapped onto the backing wall 57, and the siding 43".

Figure 6:
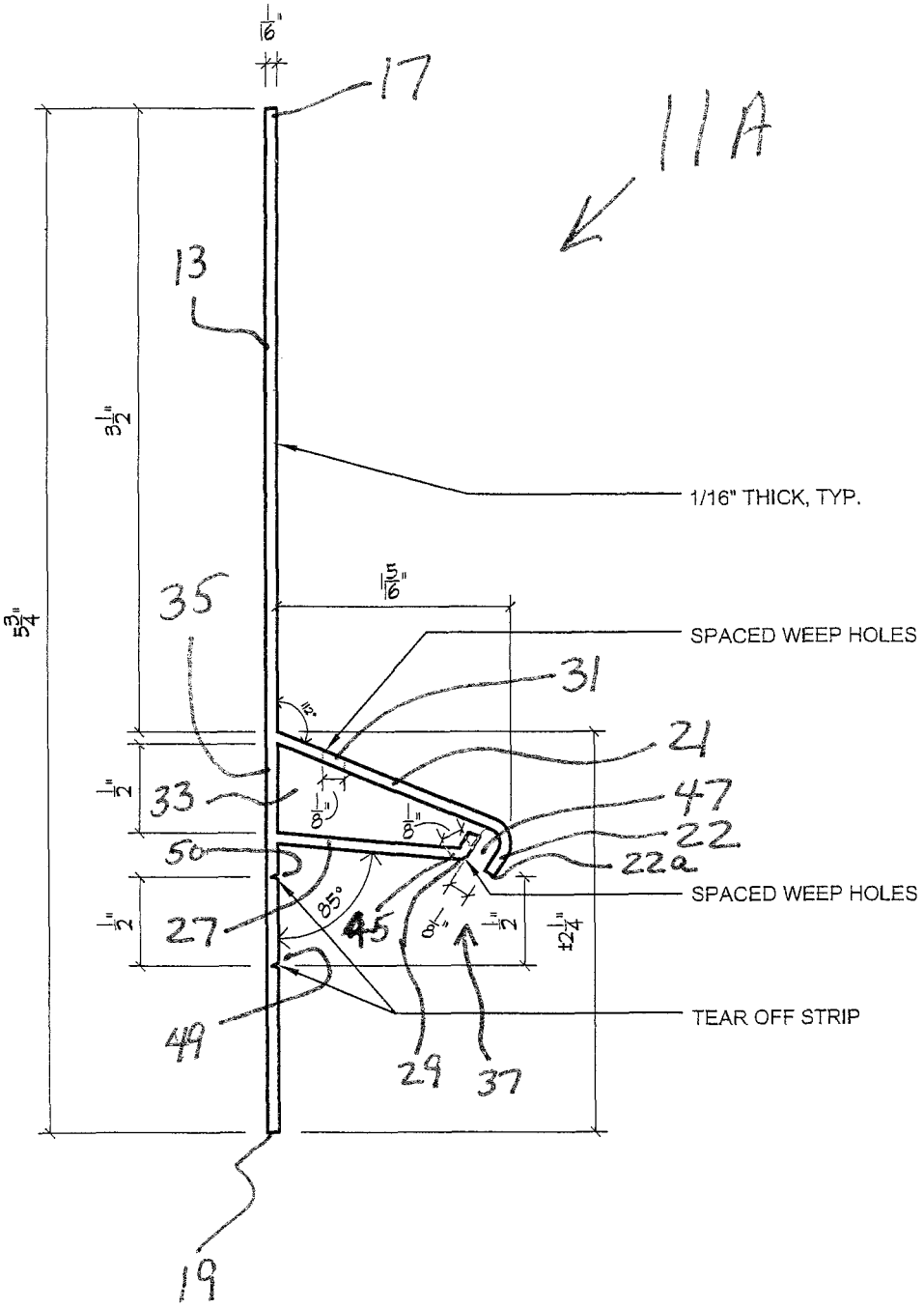
FIG. 6 is a view in side elevation of an alternative embodiment of the inventive weep screed.
Figure 7:
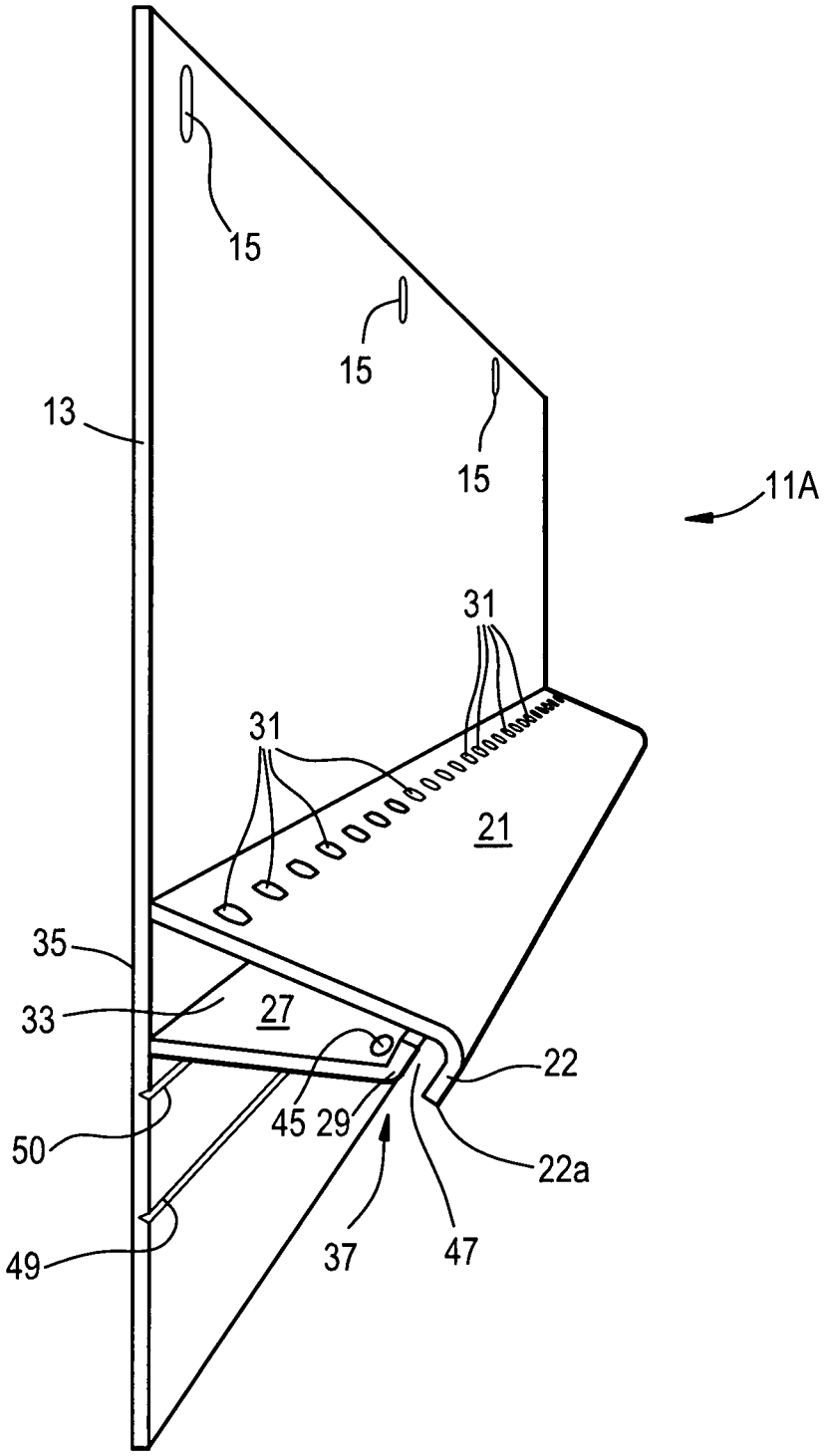
FIG. 7 is a view in perspective of the alternative embodiment of the inventive weep screed shown in FIG. 6.

Turning now to FIGS. 6 and 7, an alternative embodiment of the inventive weep screed is shown and identified with reference number 11A. In this alternative embodiment of the invention, weep screed 11A is identical to weep screed 11, except that weep screed 11A does not include the optional retaining flange 23. This embodiment of the invention includes means for providing a drainage path for moisture located in the space 39 between the weather resistant barrier 41 (such as Tyvek), which is wrapped onto the backing wall 57 of the wall, and the exterior cladding 43 of the wall to drain from between the weather resistant barrier 41 (such as Tyvek) and the exterior cladding 43 to outside the exterior wall away from the building, and for providing ventilation to the space 39 between the weather resistant barrier 41 (such as Tyvek), which is wrapped onto the backing wall 57, and the exterior cladding 43. Specifically, in the embodiment of the invention shown in FIGS. 6-7, such means comprises the opening(s) 31 formed in and extending through the primary ground flange 21, the interior of the chamber 33, the opening(s) 45 formed in and extending through the outer end portion 29 of the secondary ground flange 27, and the gap 47 between the outer end portion 22 of the primary ground flange 21 and the outer end portion 29 of the secondary ground flange 27.

Figure 8:
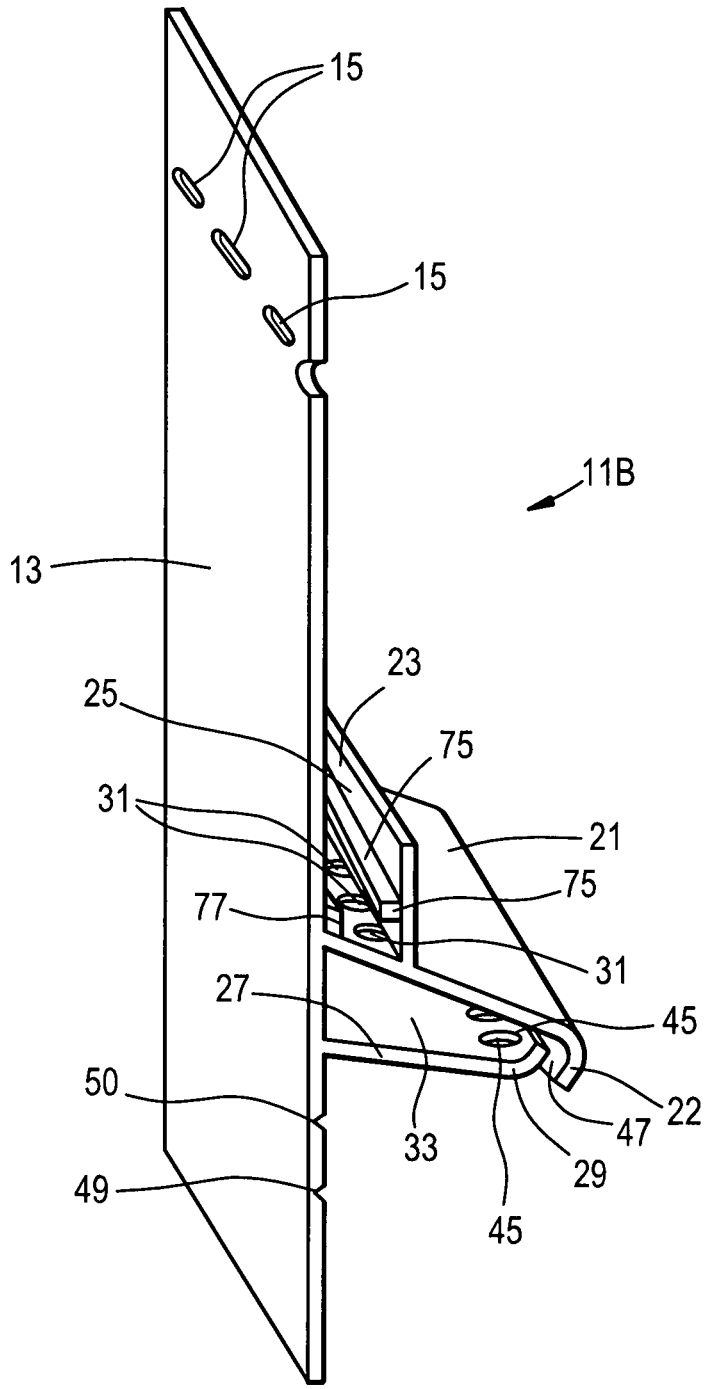
FIG. 8 is a view in perspective of another alternative embodiment of the inventive weep screed.

Turning now to FIG. 8, another alternative embodiment of the inventive weep screed is shown and identified with reference number 11B. In this alternative embodiment of the invention, weep screed 11B is identical to weep screed 11, except that weep screed 11B includes a primary support flange 75 for supporting a starter strip 73 and/or a drainage mat 61. The primary support flange 75 preferably extends across the entire length of the retaining flange 23 along its inside surface 25, and is positioned apart from the opening(s) 31 formed in the primary ground flange 21. Weep screed 11B preferably, but optionally, also includes a secondary support flange 77 for supporting a starter strip 73 and/or a drainage mat 61. The secondary support flange 77 preferably extends across the length of the vertical attachment flange 13 above the primary ground flange 21 where the vertical attachment flange 13 and the primary ground flange 21 meet. The primary support flange 75 and the secondary support flange 77 support the drainage mat 61, when present in the exterior wall, above and away from the opening(s) 31 in the primary ground flange 21, and place any starter strips 73 placed thereon at a proper angle to facilitate proper installation of the exterior cladding 43 such as siding.

An alternative inventive wall is substantially the same as the inventive wall 55, except it includes the weep screed 11B rather than the weep screed 11.

Figure 9:
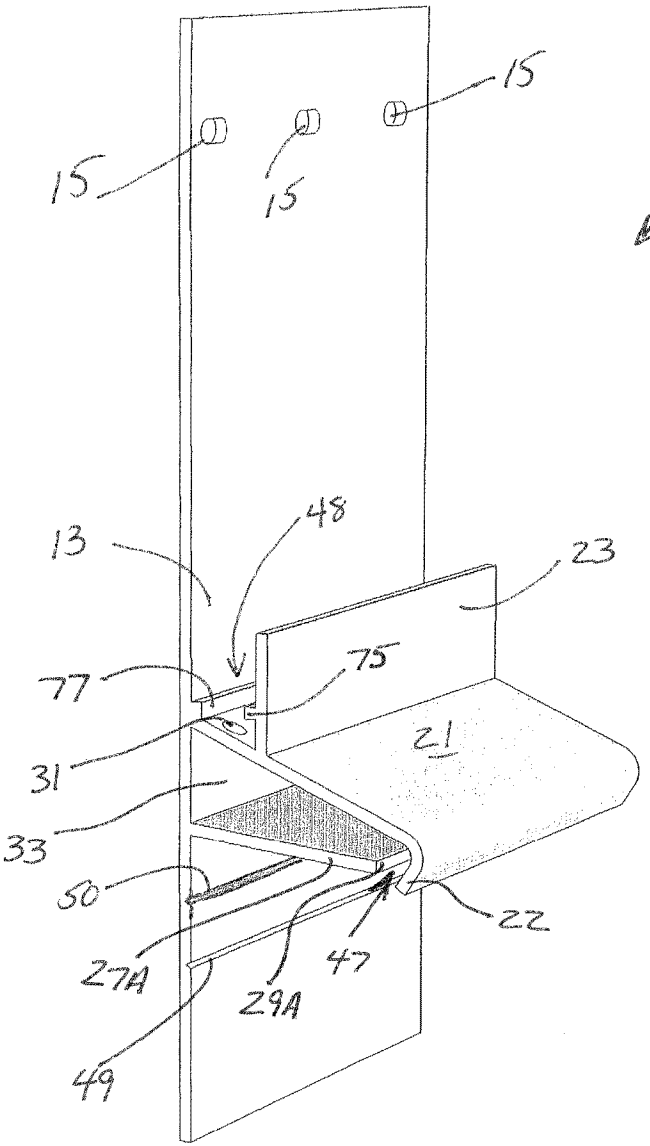
FIG. 9 is a view in perspective of another alternative embodiment of the inventive weep screed.
Figure 10:
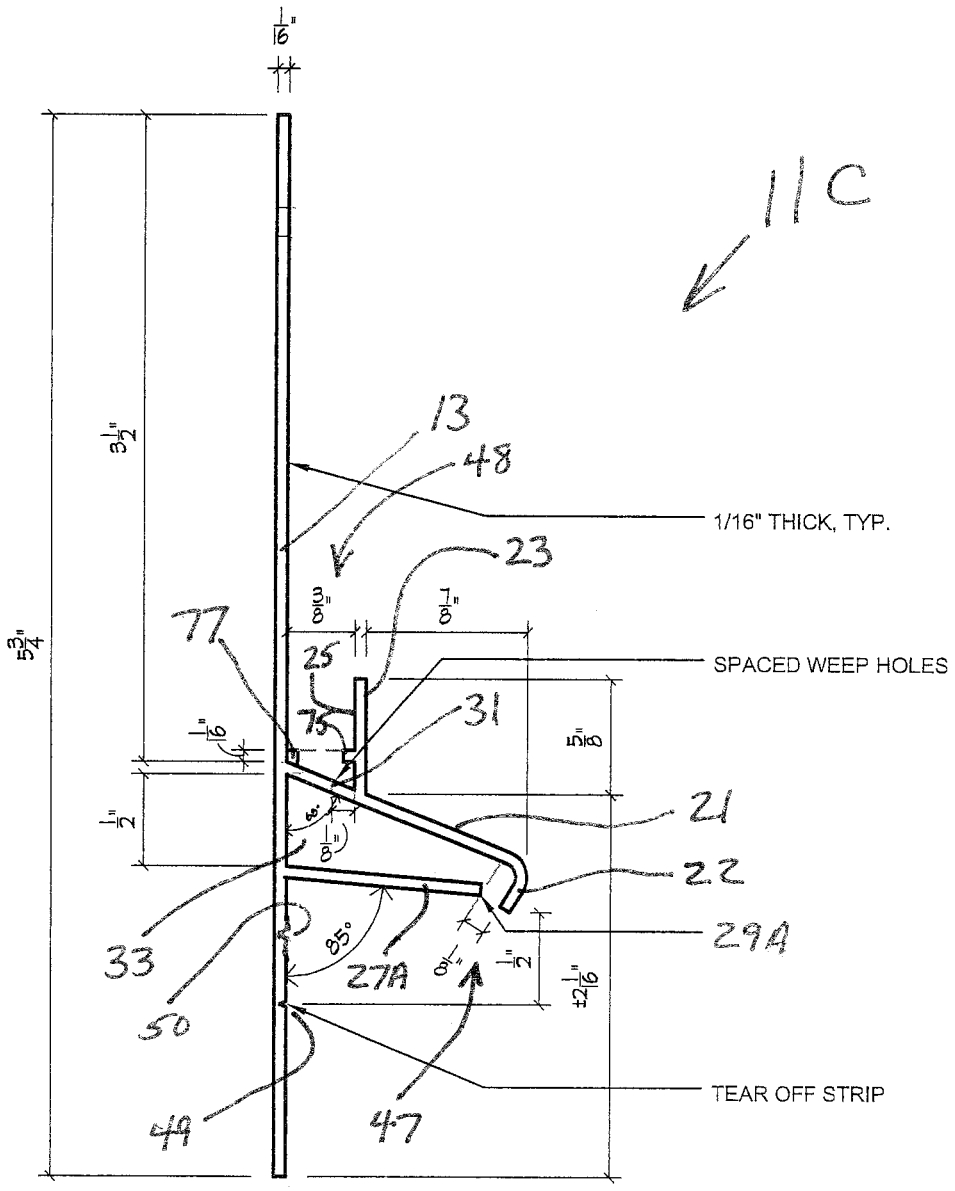
FIG. 10 is a view in side elevation of the alternative embodiment of the inventive weep screed shown in FIG. 9.
Figure 11:
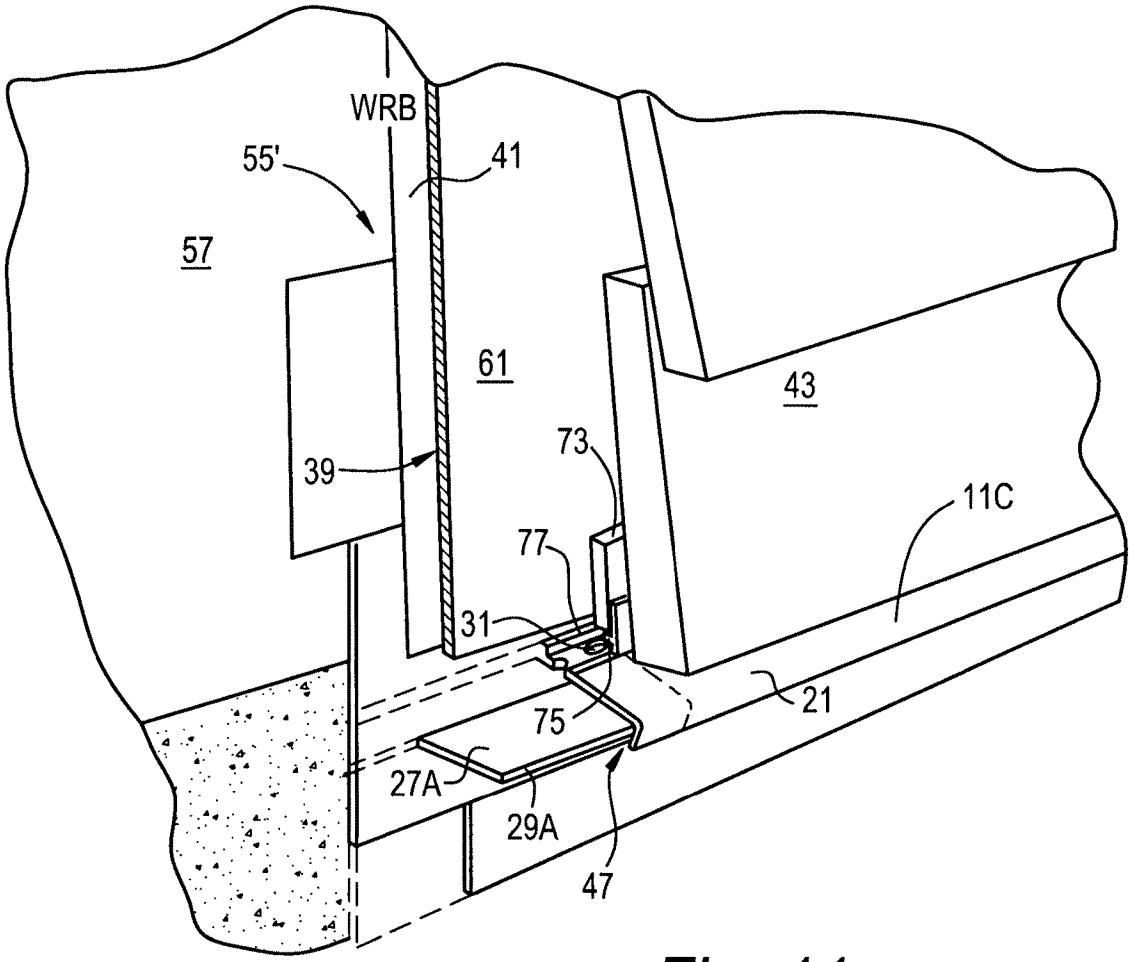
FIG. 11 is a view in perspective of another alternative embodiment of the inventive wall that includes the weep screed shown in FIGS. 9 and 10. Various portions have been cut away to illustrate details of the inventive wall.

Turning now to FIGS. 9-11, another alternative embodiment of the inventive weep screed is shown and identified with reference number 11C, and FIG. 11 shows an alternative embodiment of the inventive wall which is identified with reference number 55'. Like weep screed 11B, weep screed 11C includes a primary support flange 75 for supporting a starter strip 73 and/or a drainage mat 61 as shown in FIG. 11. The primary support flange 75 preferably extends across the entire length of the retaining flange 23 along its inside surface 25, and is positioned apart from the opening(s) 31 formed in the primary ground flange 21. Weep screed 11C preferably, but optionally, also includes a secondary support flange 77 for supporting a starter strip 73 and/or a drainage mat 61. The secondary support flange 77 preferably extends across the length of the vertical attachment flange 13 above the primary ground flange 21 where the vertical attachment flange 13 and the primary ground flange 21 meet. The primary support flange 75 and the secondary support flange 77 support the drainage mat 61, when present in the exterior wall 55', above and away from the opening(s) 31 in the primary ground flange 21, and place any starter strips 73 placed thereon at a proper angle to facilitate proper installation of the exterior cladding 43 such as sliding. In this embodiment of the invention, weep screed 11C is identical to weep screed 11B, except that instead of having secondary ground flange 27, weep screed 11C has a secondary ground flange 27A extending outwardly at an obtuse angle from the vertical attachment flange 13, the secondary ground flange 27A having no openings 45 formed in its outer end portion 29A, and the outer end portion 29A of the secondary ground flange 27A not curving upwardly or downwardly. Like secondary ground flange 27, secondary ground flange 27A extends outwardly at any angle greater than 90 degrees and less than 180 degrees, and preferably is 95 degrees downwardly from the vertical attachment flange 13. Preferably, the obtuse angle is such that the secondary ground flange 27 projects downwardly at an angle sufficiently downwardly and outwardly to provide direction to water, such as rain, that has penetrated into the wall and/or has been absorbed by the wall, and has drained downwardly to the primary ground flange 21, so that such water flows along the secondary ground flange 27 away from the building.

This embodiment of the invention shown in FIGS. 9-11 includes means for providing a drainage path for moisture located in the space 39 between the weather resistant barrier 41 (such as Tyvek), which is wrapped onto the backing wall 57 of the wall, and the exterior cladding 43 of the wall to drain from between the weather resistant barrier 41 (such as Tyvek) and the exterior cladding 43 to outside the exterior wall away from the building, and for providing ventilation to the space 39 between the weather resistant barrier 41 (such as Tyvek), which is wrapped onto the backing wall 57, and the exterior cladding 43. Specifically, in the embodiment of the invention shown in FIGS. 9-11, such means comprises the recess 48 leading to the opening(s) 31, the opening(s) 31 formed in the extending through the primary ground flange 21, the interior of the chamber 33, and the gap 47 between the outer end portion 22 of the primary ground flange 21 and the outer end portion 29A of the secondary ground flange 27A.

The inventive wall 55' is substantially the same as the inventive wall 55, except it includes the weep screed 11C rather than the weep screed 11B.

Figure 12:
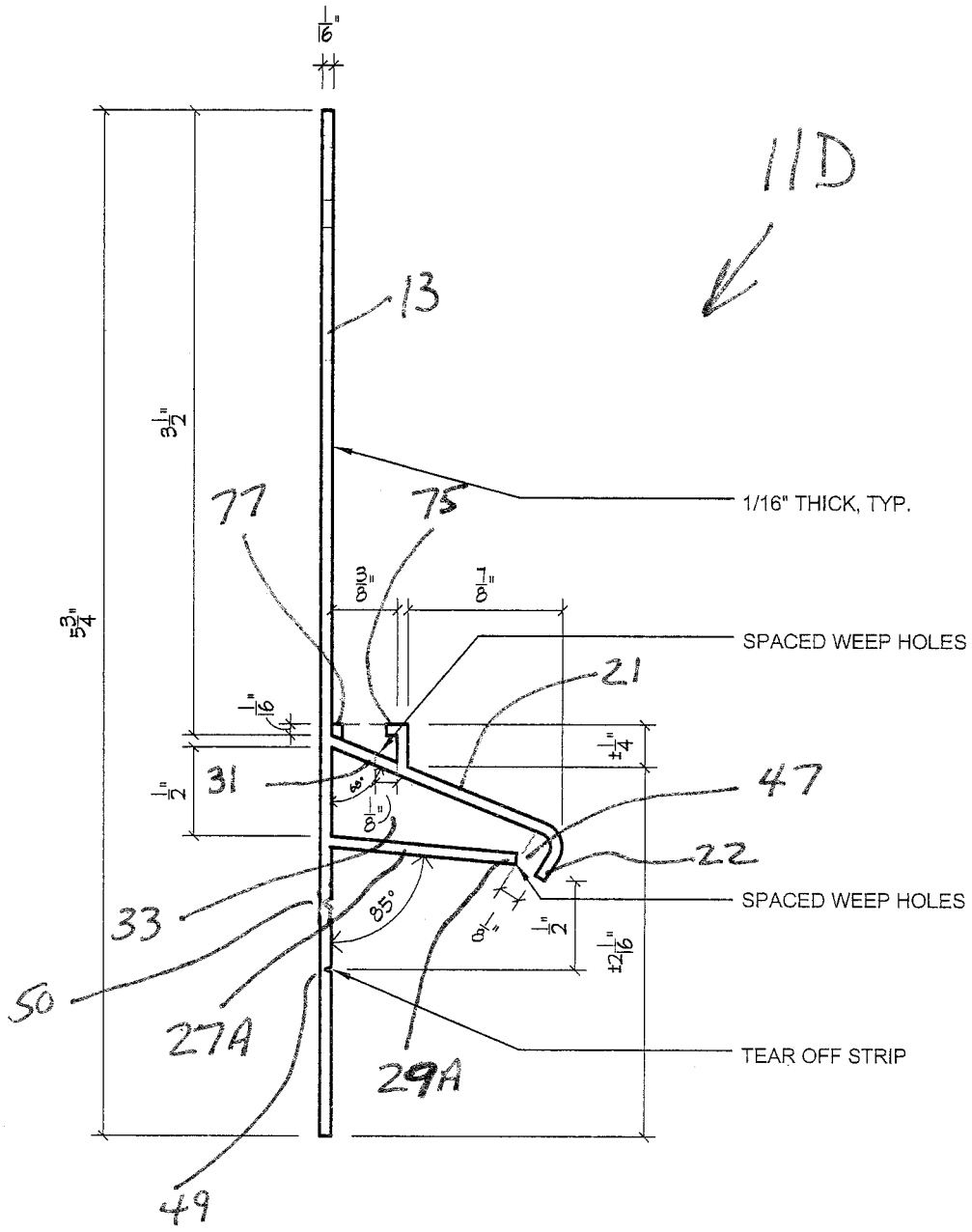
FIG. 12 is a view in side elevation of another alternative embodiment of the inventive weep screed.
Figure 13:
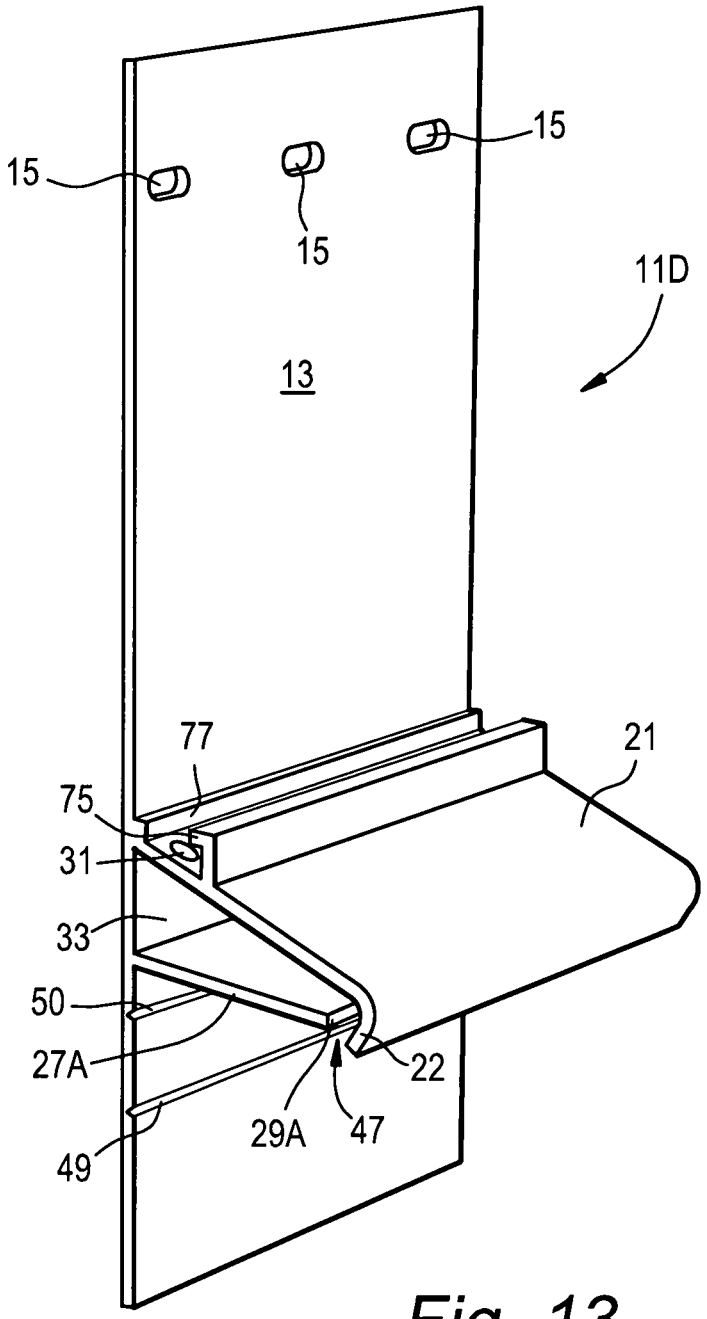
FIG. 13 is a view in perspective of the alternative embodiment of the inventive weep screed shown in FIG. 12.

Turning now to FIGS. 12 and 13, another alternative embodiment of the inventive weep screed is shown and identified with reference number 11D. In this embodiment of the invention, weep screed 11D is identical to weep screed 11C, except that weep screed 11D does not include the portion of retaining flange 23 above the primary support flange 75. This embodiment of the invention shown in FIGS. 12-13 includes means for providing a drainage path for moisture located in the space 39 between the weather resistant barrier 41 (such as Tyvek), which is wrapped onto the backing wall 57 of the wall, and the exterior cladding 43 of the wall to drain from between the weather resistant barrier 41 (such as Tyvek) and the exterior cladding 43 to outside the exterior wall away from the building, and for providing ventilation to the space 39 between the weather resistant barrier 41 (such as Tyvek), which is wrapped onto the backing wall 57, and the exterior cladding 43. Specifically, in the embodiment of the invention shown in FIGS. 12-13, such means comprises the opening(s) 31 formed in and extending through the primary ground flange 21, the interior of the chamber 33, and the gap 47 between the outer end portion 22 of the primary ground flange 21 and the outer end portion 29A of the secondary ground flange 27A.

Figure 14:
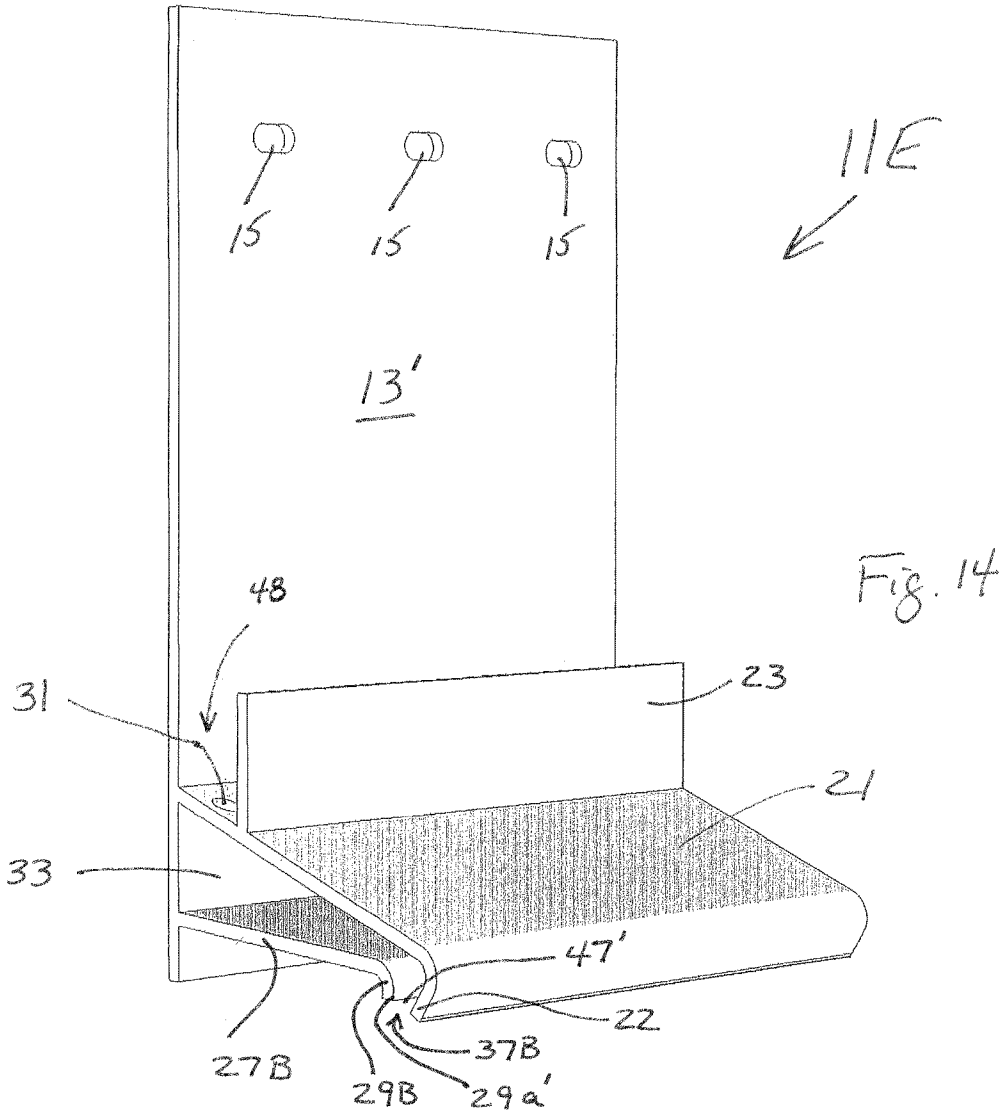
FIG. 14 is a view in perspective of another alternative embodiment of the inventive weep screed.
Figure 15:
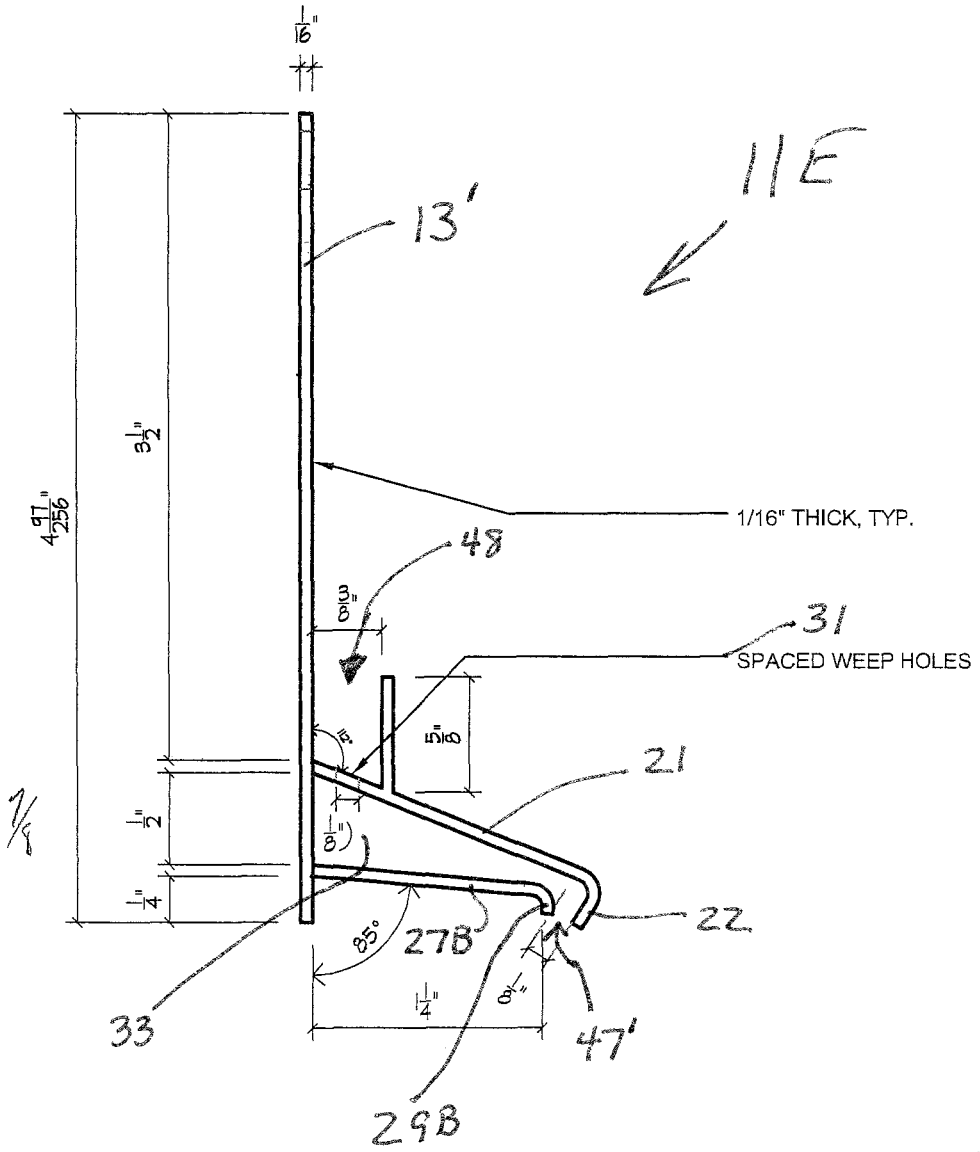
FIG. 15 is a view in side elevation of the weep screed shown in FIG. 14.
Figure 16:
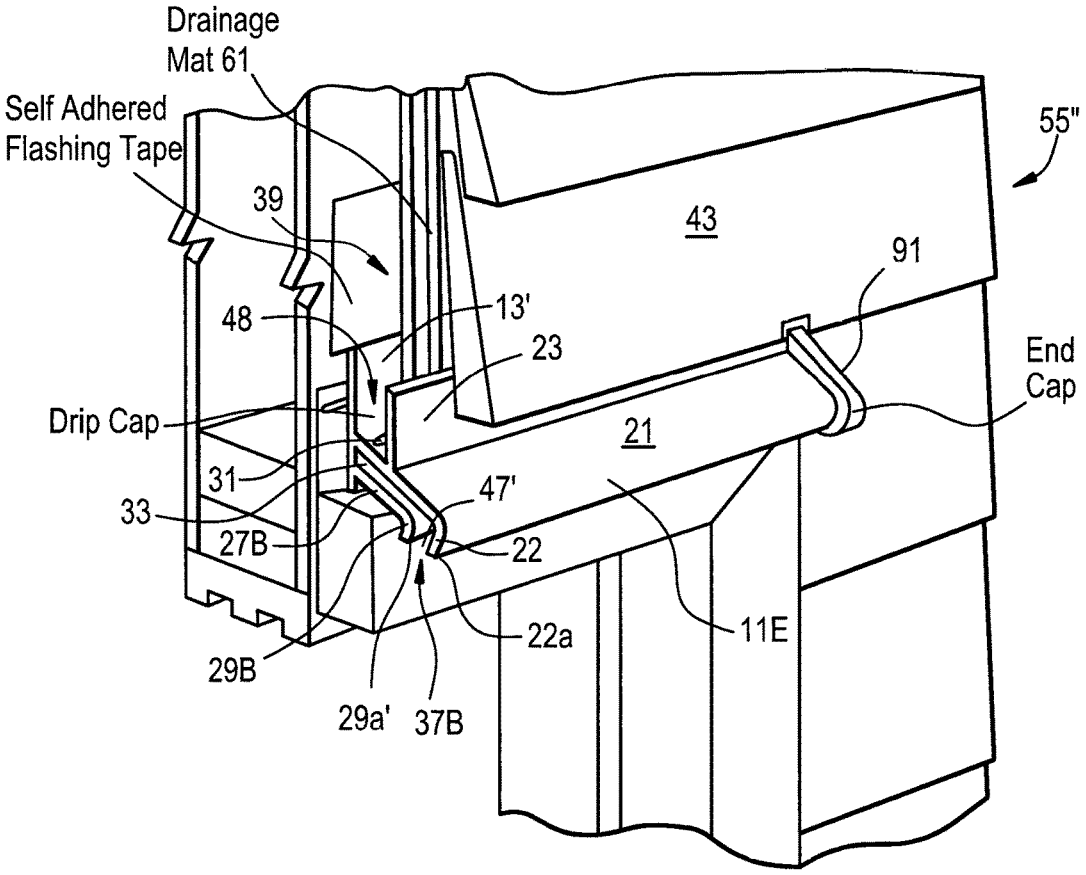
FIG. 16 is a view in perspective of another inventive wall that includes the weep screed shown in FIGS. 14 and 15. Various portions have been cut away to illustrate details of the inventive wall.

Turning now to FIGS. 14-16, another alternative embodiment of the inventive weep screed is shown and identified by reference number 11E, and FIG. 11 shows another alternative embodiment of the inventive wall which is identified with the reference number 55". In these alternative embodiments of the invention, weep screed 11E preferably functions as a drip cap to be mounted above a window or door placed in the exterior wall 55". Weep screed 11E is identical to weep screed 11, except that weep screed 11E has a secondary ground flange 27B that is substantially the same as secondary ground flange 27 except that the secondary ground flange 27B has an outer end portion 29B that does not include opening(s) 45. Rather, the outer end portion 29B projects downwardly to form a drip line 29*a'*, from which moisture that has drained into the cavity 33 via the opening(s) 31 may flow from the cavity 33 and fall away from the building. Accordingly, the entrance/exit port 37B of weep screed 11E through which air may enter to provide ventilation to the space 39 between the weather resistant barrier 41 (such as Tyvek), which is wrapped onto the backing wall 57, and the exterior cladding 43, and from which moisture and moisture vapor that has drained into the chamber 33 from the space 39 between the weather resistant barrier 41 (such as Tyvek), which is wrapped onto the backing wall 57, and the exterior cladding 43 via the opening(s) 31 may drain from the chamber 33 and fall away from the building, comprises only a gap 47' formed between the outer end portion 22 of the primary ground flange 21 and the outer end portion 29B of the secondary ground flange 27B. The weep screed 11E also differs from the weep screed 11 in that weep screed 11E has a vertical attachment flange 13' that does not include the grooves 49 or 50 or the portions 53 or 54 of the vertical attachment flange 13 of the weep screed 11 since the weep screed 11E does not need a vertical attachment flange having an extended lower end portion.

In the embodiments of the invention shown in FIGS. 14-16, means for providing a drainage path for moisture located in the space 39 between the weather resistant barrier 41 (such as Tyvek), which is wrapped onto the backing wall 57 of the wall, and the exterior cladding 43 of the wall to drain from the space 39 between the weather resistant barrier 41 (such as Tyvek) and the exterior cladding 43 to outside the exterior wall away from the building, and for providing ventilation to the space 39 between the weather resistant barrier 41 (such as Tyvek), which is wrapped onto the backing wall 57, and the exterior cladding 43, comprises the recess 48 leading to the opening(s) 31, the opening(s) 31 formed in and extending through the primary ground flange 21, the interior of the chamber 33, and the gap 47' between the outer end portion 22 of the primary ground flange 21 and the outer end portion 29B of the secondary ground flange 27B.

The constructional structure of the inventive wall 55" is substantially the same as the inventive wall 55, except in the inventive wall 55", a weep screed 11E is provided on the wall 55" preferably above a window or door placed in the exterior wall 55", rather than at the bottom of the wall 55 at foundation level of the building. The inventive wall 55" also may have an inventive weep screed, such as a weep screed 11, positioned on the exterior wall 55" at the bottom of the exterior wall 55" at foundation level of the building.

The weep screed 11E, as stated above, preferably is used as a drip cap to be mounted above a window or door placed in the exterior wall 55". Accordingly, when used as a drip cap, weep screed 11E helps support the exterior cladding 43 of the exterior wall 55" resting on its primary ground flange 21, provides a water barrier between the exterior wall 55" and the frame or jamb of the window or door over which a part of the weep screed 11E covers, directs water that penetrates the exterior cladding 43 and drains downwardly in the exterior cladding 43 to the weep screed 11E to flow downwardly along the primary ground flange 21 to the drip line 22*a* and then fall away from the building, permits moisture located in the space 39 between the weather resistant barrier 41 (such as Tyvek), which is wrapped onto the backing wall 57, and the exterior cladding 43 to drain from the space 39 between the weather resistant barrier 41 (such as Tyvek) and the exterior cladding 43 and be directed via the pathway formed via the recess 48, the opening(s) 31, the chamber 33, and the gap 47' away from the building, and provides ventilation via the pathway formed via the recess 48, the opening(s) 31, the chamber 33, and the gap 47' to the space 39 between the weather resistant barrier 41 (such as Tyvek) and the exterior cladding 43, thereby permitting the exterior wall 55" to dry.

Figure 17:
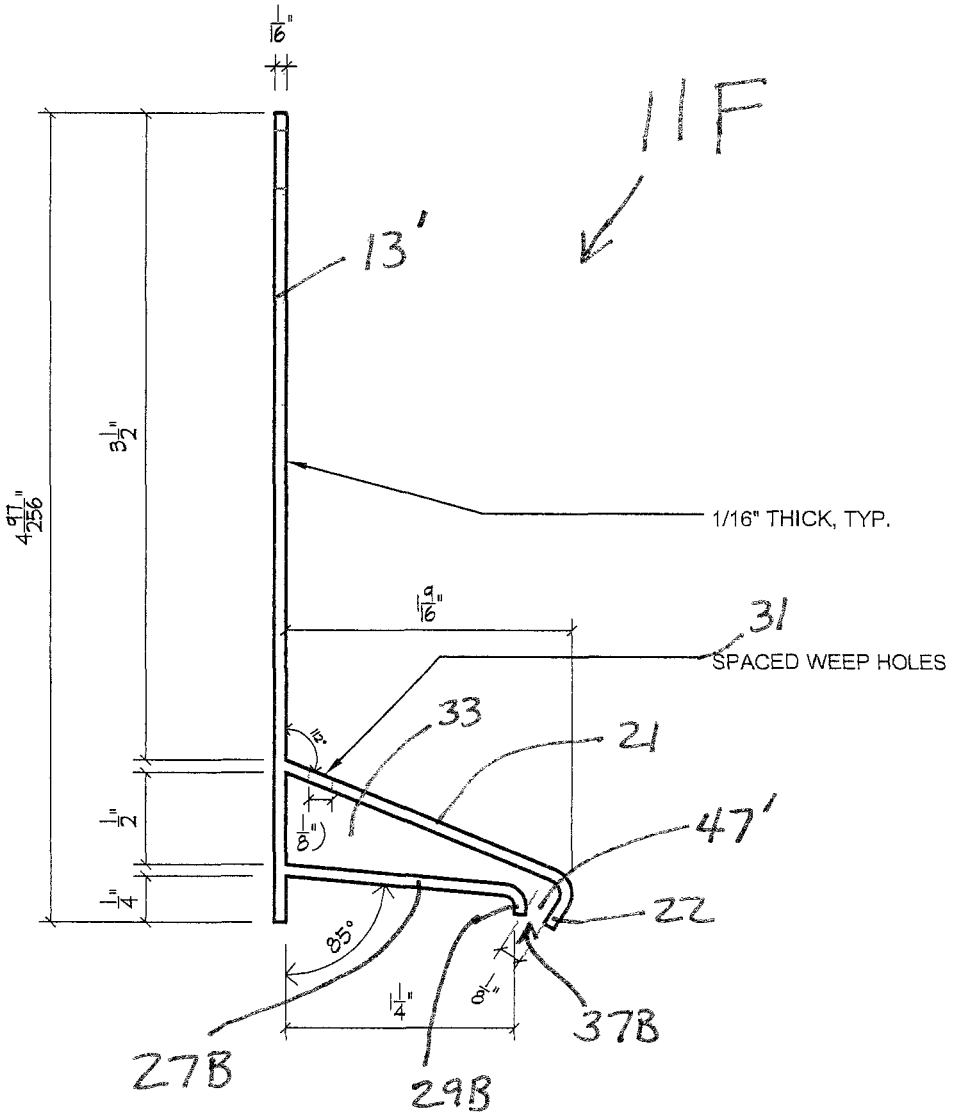
FIG. 17 is a view in side elevation of another alternative embodiment of the inventive weep screed.
Figure 18:
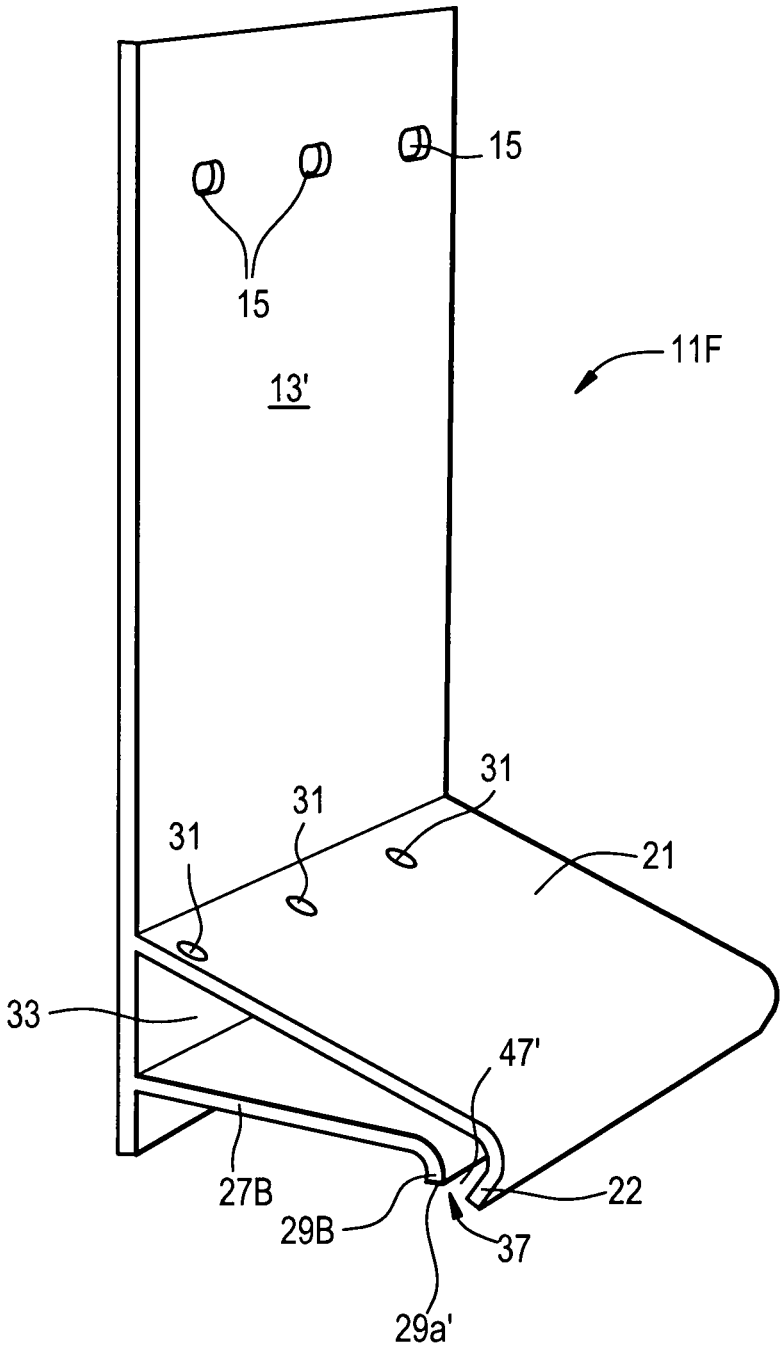
FIG. 18 is a view in perspective of the weep screed shown in FIG. 17.
Figure 19:
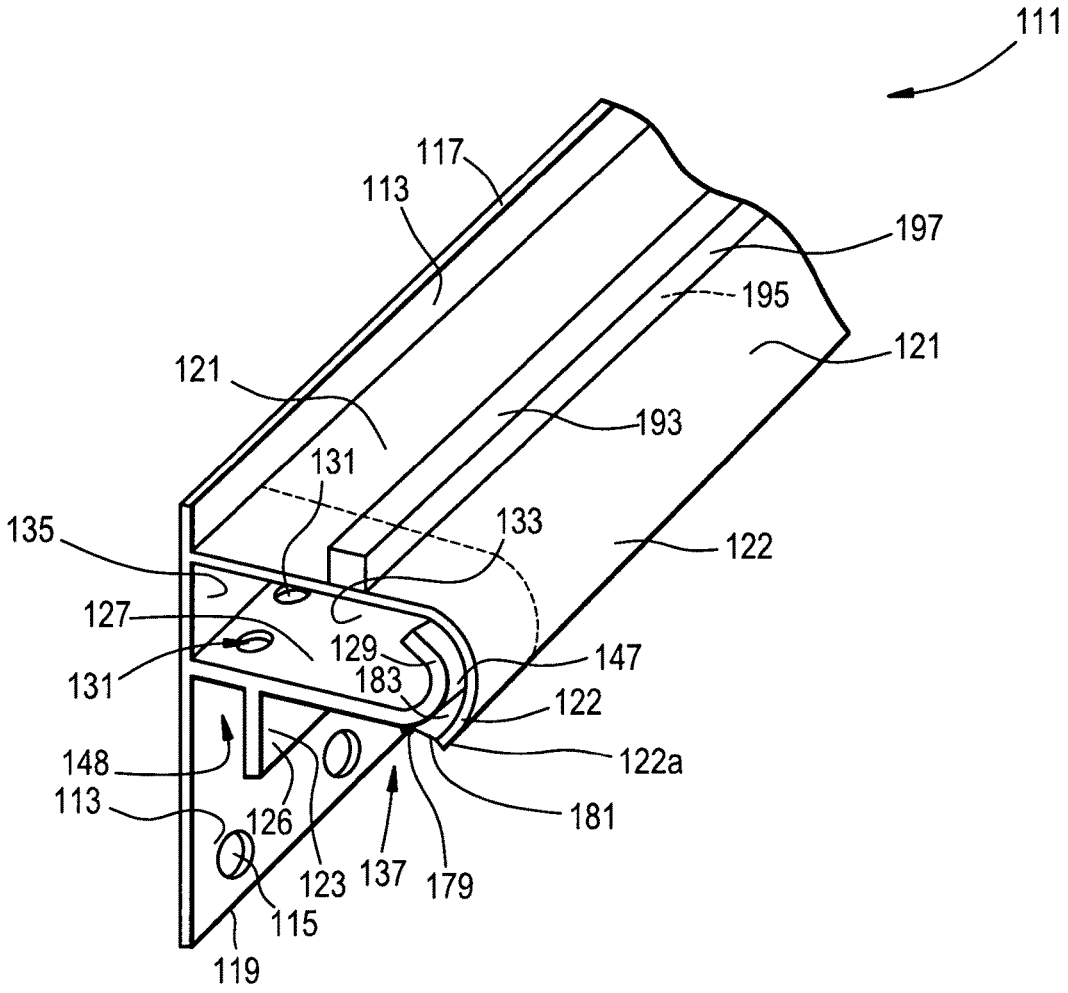
FIG. 19 is a view in perspective of another alternative embodiment of the inventive weep screed.
Figure 20:
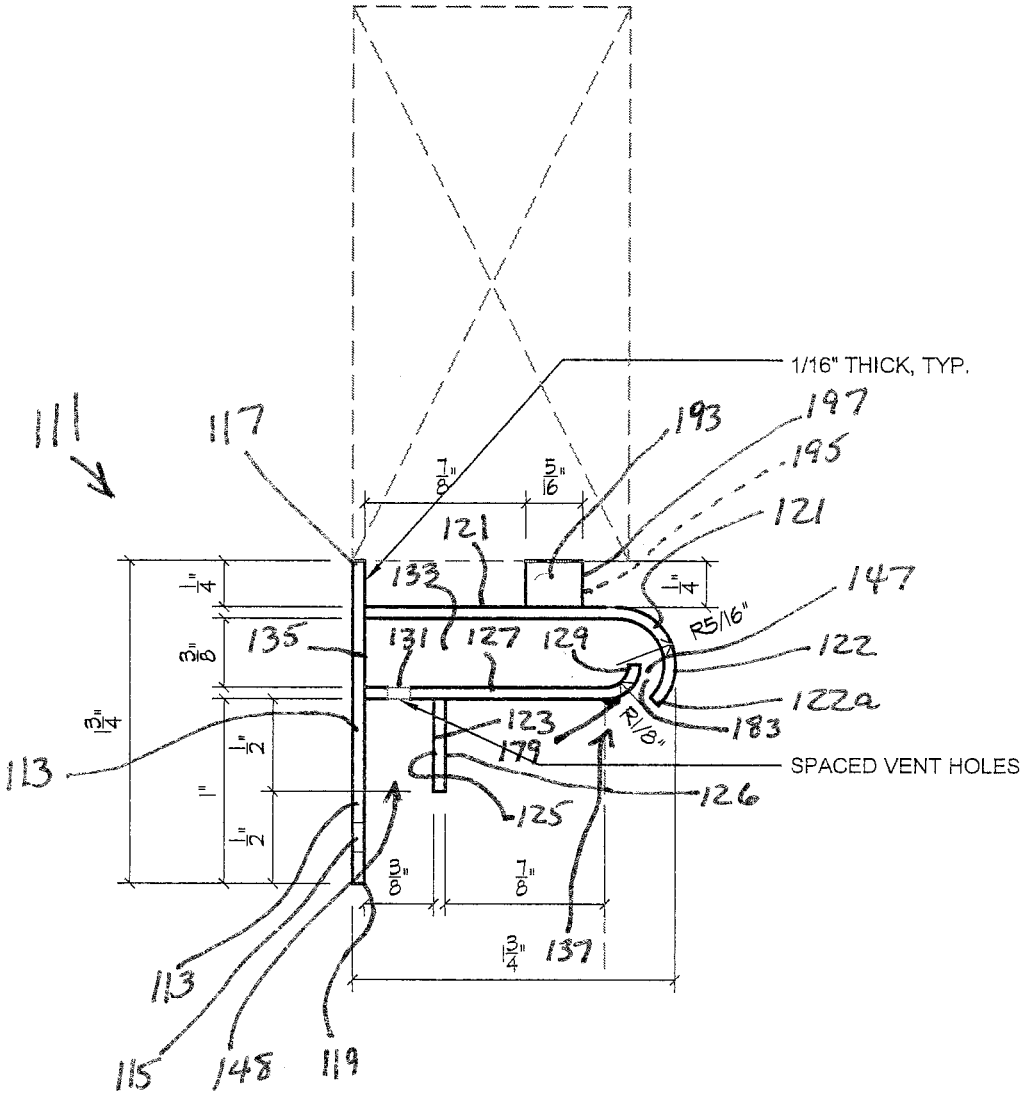
FIG. 20 is a view in side elevation of the weep screed shown in FIG. 19.

Turning now to FIGS. 17 and 18, another alternative embodiment of the inventive weep screed is shown and identified with reference number 11F. In this embodiment of the invention, weep screed 11F is identical to weep screed 11E, except that weep screed 11F does not include the optional retaining flange 23. This embodiment of the invention shown in FIGS. 17-18-includes means for providing a drainage path for moisture located in the space 39 between the weather resistant barrier 41 (such as Tyvek), which is wrapped onto the backing wall 57 of the wall, and the exterior cladding 43 of the wall to drain from between the weather resistant barrier 41 (such as Tyvek) and the exterior cladding 43 to outside the exterior wall away from the building, and for providing ventilation to the space 39 between the weather resistant barrier 41 such as Tyvek, which is wrapped onto the backing wall 57, and the exterior cladding 43. In the embodiment of the invention shown in FIGS. 17-18, such means comprises the opening(s) 31 formed in and extending through the primary ground flange 21, the interior of the chamber 33 and the gap 47' between the outer end portion 22 of the primary ground flange 21 and the outer end portion 29B of the secondary ground flange 27B.

Figure 21:
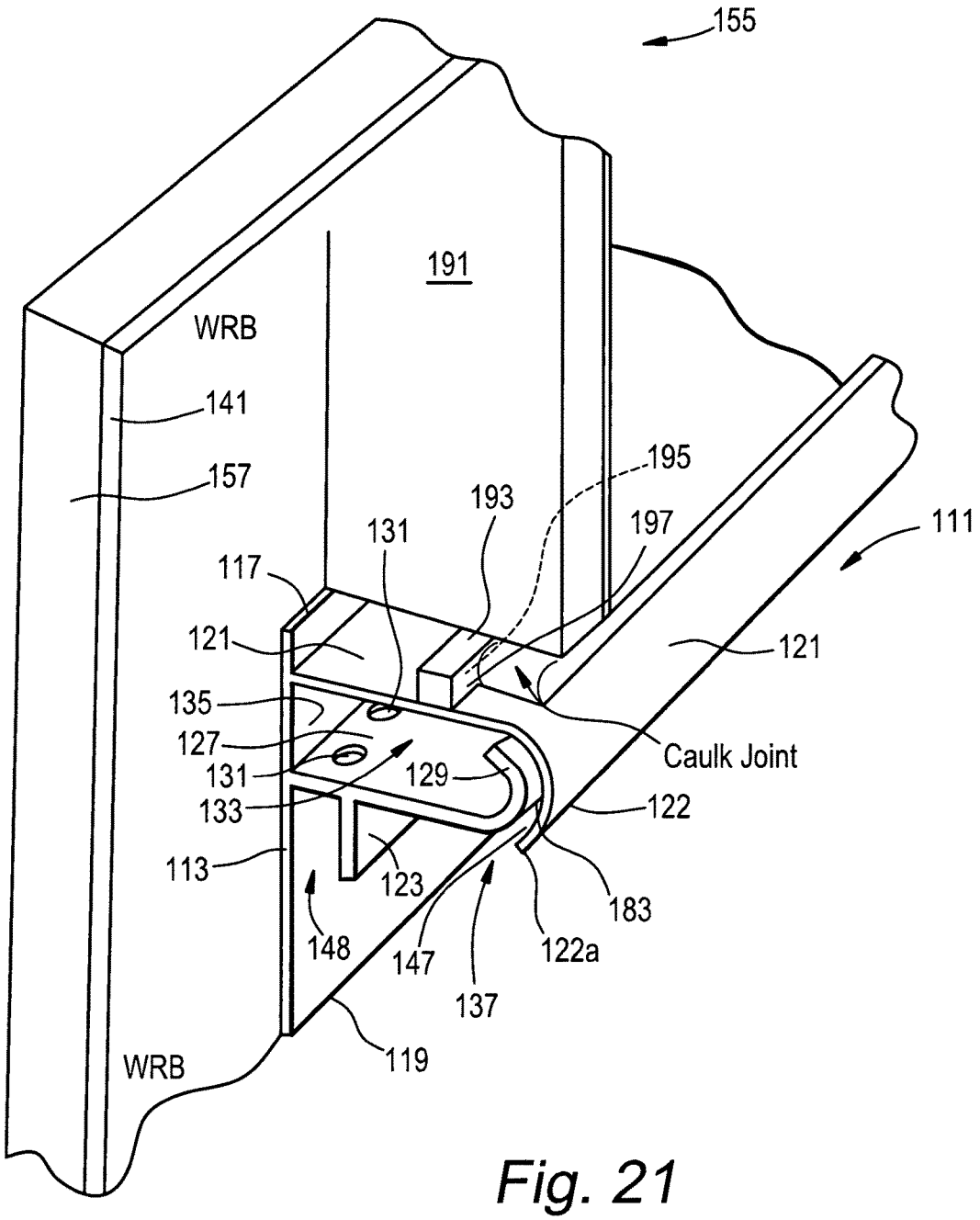
FIG. 21 is a view in perspective of an alternative embodiment of the inventive wall that includes the weep screed shown in FIGS. 19 and 20. Various portions have been cut away to illustrate details of the inventive wall.
Figure 22:
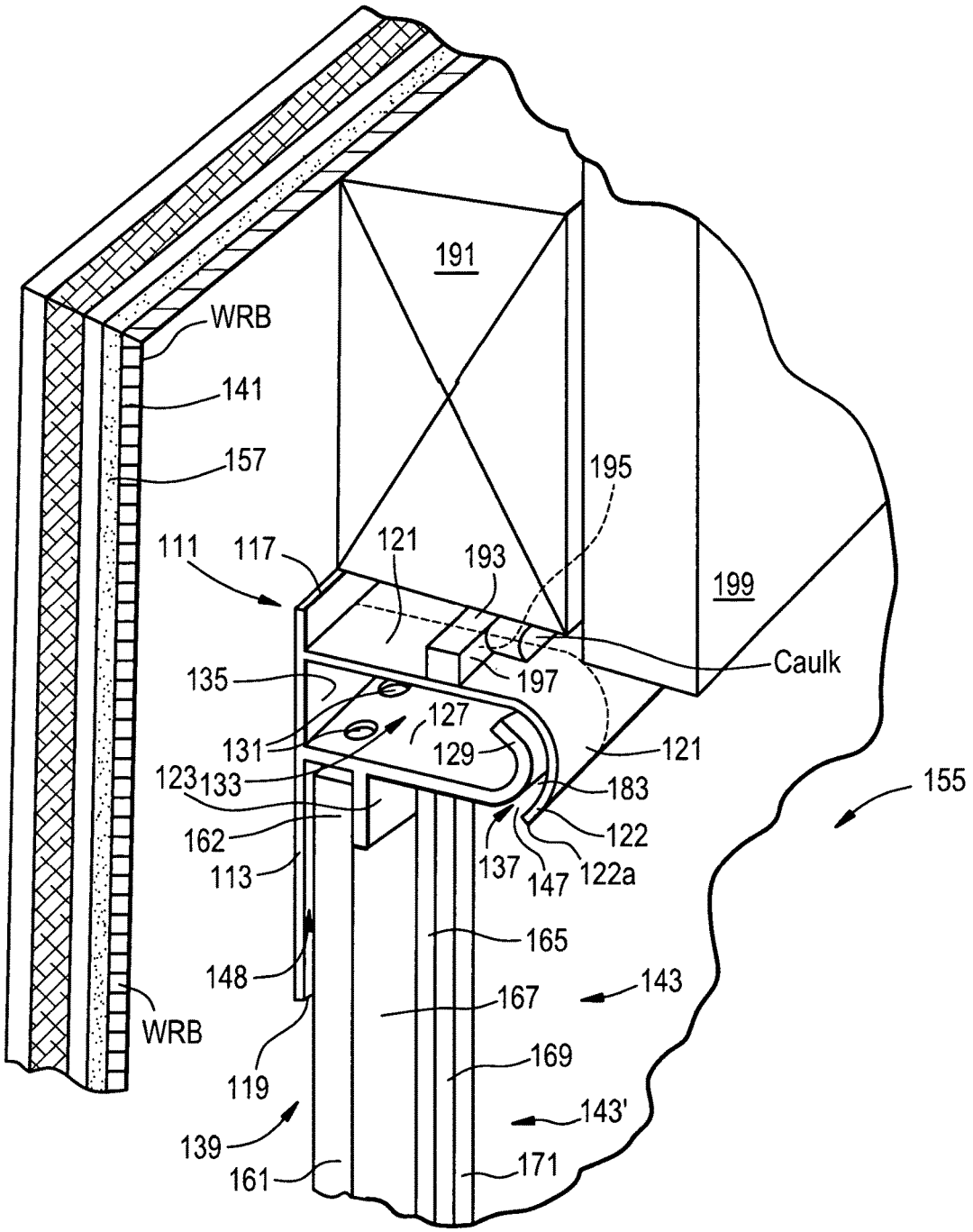
FIG. 22 is a view in perspective of an alternative embodiment of the inventive wall that includes the weep screed shown in FIGS. 19 and 20. Various portions have been cut away to illustrate details of the inventive wall.
Figure 23:
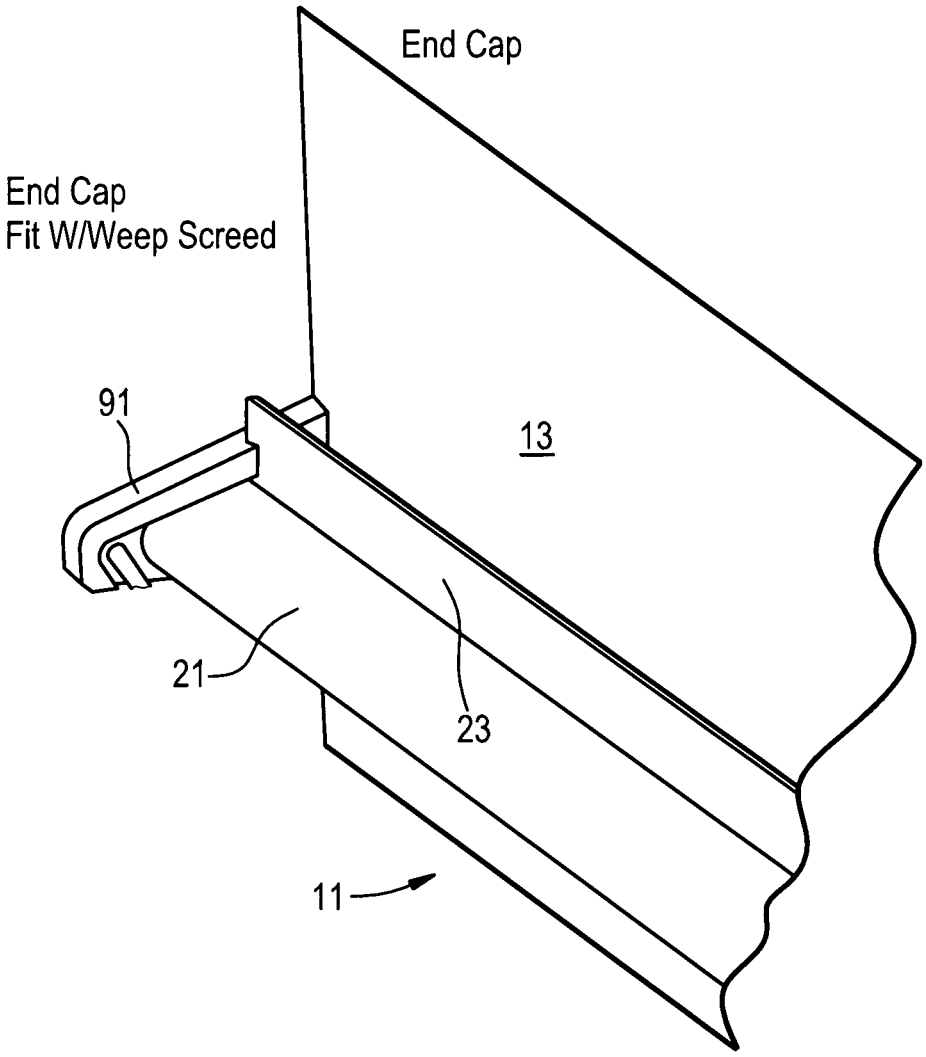
FIG. 23 is a view in perspective of a weep screed of the invention with an inventive end cap constructed in accordance with the invention mounted thereon.
Figure 24:
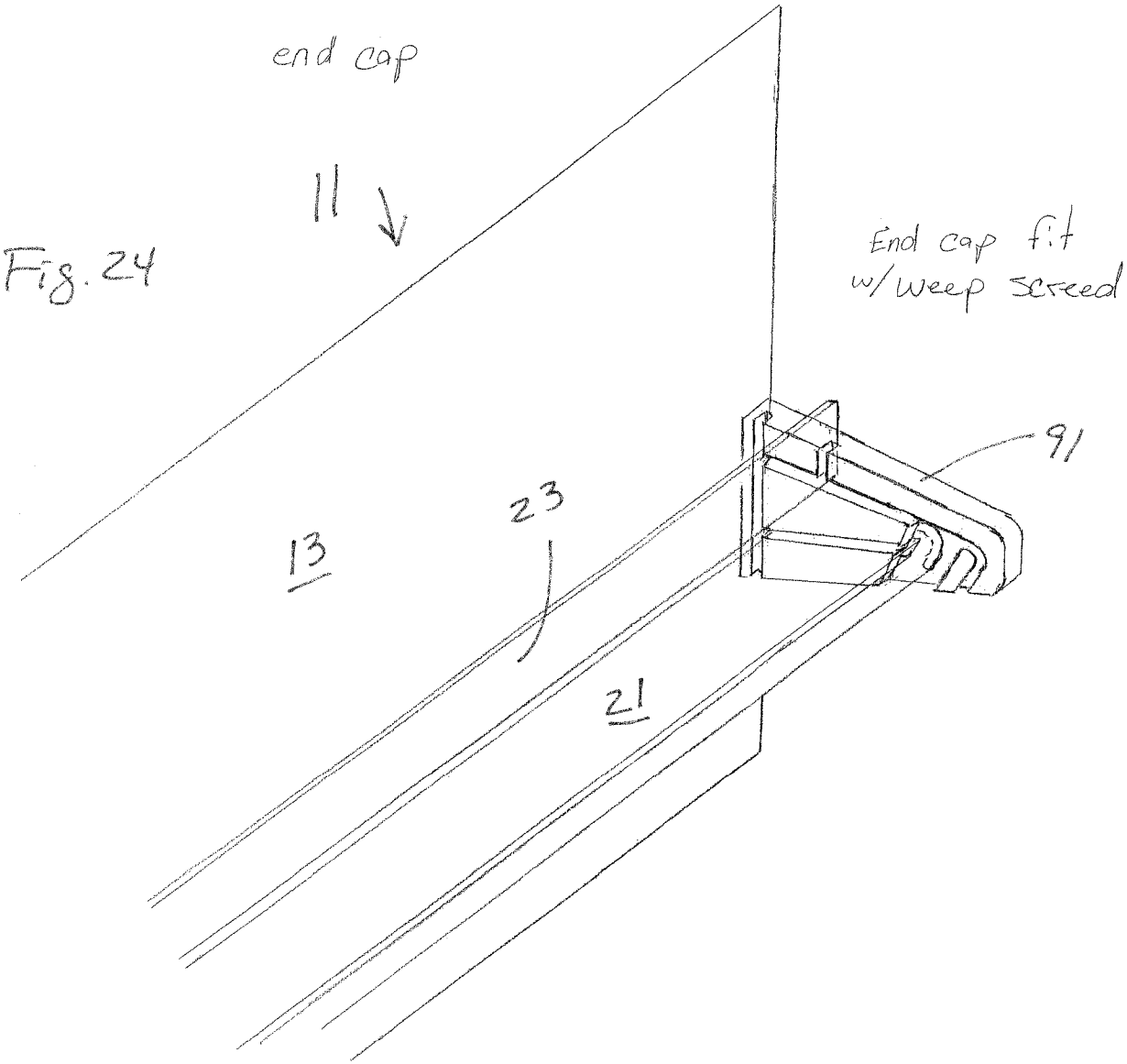
FIG. 24 is a view in perspective of the weep screed of the invention shown in fantom with the inventive end cap shown in FIG. 23 mounted thereon.
Figure 25:
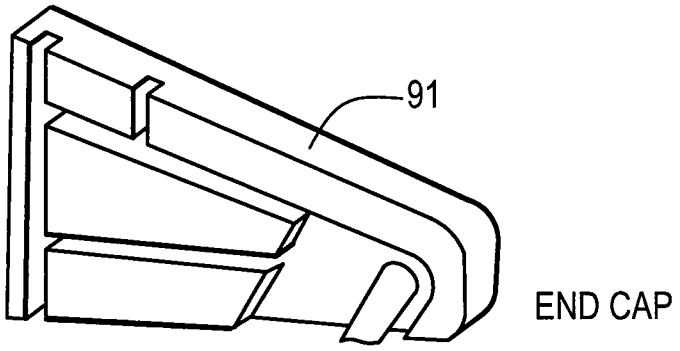
FIG. 25 is a view in perspective of the end cap shown in FIGS. 23 and 24.
Figure 26:
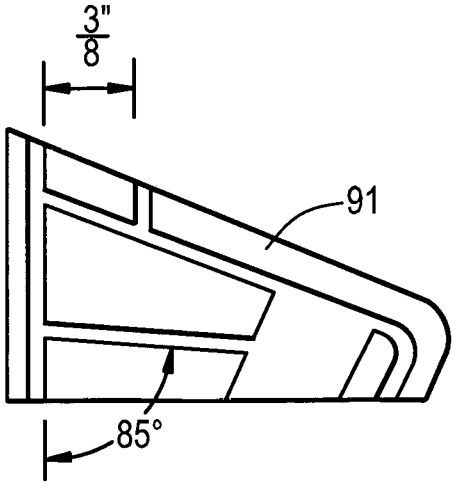
FIG. 26 is a view in elevation of the end cap shown in FIGS. 23-25.

Turning now to FIGS. 19-22, another alternative embodiment of the inventive weep screed is shown and identified by reference number 111, and FIGS. 21 and 22 show another alternative embodiment of the inventive wall which is identified with the reference number 155. In these alternative embodiments of the invention, weep screed 111 preferably functions as a top of wall termination vent that directs water that falls onto its ground flange 121 away from the exterior wall 155 and that provides a drainage path for moisture vapor located between weather resistant barrier 141 (such as Tyvek), which is wrapped onto the backing wall 157, and the exterior cladding 143 of the exterior wall 155, and that provides ventilation to the space 139 between weather resistant barrier 141 (such as Tyvek) and the exterior cladding 143 of the exterior wall 155, thereby permitting the exterior wall to dry.

Preferably, the inventive weep screed 111 is designed to be mounted on the top of an exterior wall 155 of a building to help support the packing material 191 of the exterior wall 155 resting on the weep screed 111, direct water that penetrates the facia or freeze board 199, and drains downwardly to the weep screed 111 to flow along the primary ground flange 121 to the drip line 122*a* and then fall away from the building, permit moisture vapor located between the weather resistant barrier 141 (such as Tyvek), which is wrapped onto the backing wall 157 of the exterior wall 155, and the exterior cladding 143 to flow from the space 139 between the weather resistant barrier 141 (such as Tyvek) and the exterior cladding 143 and be directed away from the building, and provide ventilation to the space 139 between the weather resistant barrier 141 (such as Tyvek) and the exterior cladding 143, thereby permitting the exterior wall 155 to dry.

The weep screed 111 has a vertical attachment flange 113 (which also may be referred to as a nailing flange or a vertical member or a vertical attachment member or a vertical attachment panel) which is used to attach the weep screed 111 to a wall, preferably using nails or staples which extend through the nailing holes 115 (which also may be referred to as nailing punch-outs or nailing gauge or nailers) into the wall to hold the vertical attachment flange 113 to the wall. The vertical attachment flange 113 has an upper end 117 and a lower end 119.

The primary ground flange 121 (which also may be referred to as a ground, or ground flange, or outwardly protruding member, or primary weathering member, or primary member) preferably extends outwardly from the vertical attachment flange 113, and has a downwardly extending outer end portion 122 that forms a drip line 122*a*, from which the rain/water flowing along the primary ground flange 121 falls away from the building. Preferably, a flexible gasket 193 (preferably made of rubber) is mounted on (preferably using glue) to seal between the packing material 191 and the primary ground flange 121. Preferably, the front face 195 of the gasket 193 is provided with bond-breaking tape 197 to permit caulk to be placed adjacent to it and extend between the packing material 191 and the primary ground flange 121 to create a double-sided joint between the packing material 191 and the primary ground flange 121, rather than a triple-sided joint between the packing material 191, the primary ground flange 121, and the gasket 193.

A secondary ground flange 127 (which also may be referred to as a secondary member with lower ground, or a secondary weathering member, or a lower ground) is formed on the vertical attachment flange 113 and is positioned on the vertical attachment flange 113 between the primary ground flange 121 and the lower end 119 of the vertical attachment flange 113. The secondary ground flange 127 extends outwardly from the vertical attachment flange 113, and has an outer end portion 129 that projects upwardly towards and is spaced apart from and inwardly of the outer end portion 122 of the primary ground flange 121.

A retaining flange 123 (which also may be referred to as a drainage plane gauge, or starter retaining flange, or standoff flange) preferably, but optionally, is formed on the secondary ground flange 127, and extends downwardly and in a plane parallel to or substantially parallel to the vertical attachment flange 113. The retaining flange 123 has an inside surface 125 that faces the vertical attachment flange 113 and an outside surface 126 that faces away from the vertical attachment flange 113. The retaining flange 123 creates a recess 148 between itself and the vertical attachment flange 113.

The secondary ground flange 127 has at least one opening 131 formed therein and extending therethrough located in a portion of the secondary ground flange 127 between the vertical attachment flange 113 and the retaining flange 123. Preferably, a row of openings 131 is provided along the entire length of the secondary ground flange 127 of the weep screed 111, with each opening 131 being equally spaced from the adjacent opening 131.

A chamber 133 is defined by the primary ground flange 121, the secondary ground flange 127, and the portion 135 of the vertical attachment flange 113 that extends between the primary ground flange 121 and the secondary ground flange 127.

The chamber 133 has at least one entrance/exit port 137 through which air may enter to provide ventilation to the space 139 between the weather resistant barrier 141 (such as Tyvek), which is wrapped onto the backing wall 157, and the exterior cladding 143 and from which moisture vapor that has flowed into the chamber 133 from the space 139 between the weather resistant barrier 141 (such as Tyvek) and the exterior cladding 43 via the opening(s) 131 may flow from the chamber 133 away from the wall and the building. In the embodiment of the invention shown in FIGS. 19-22, the entrance/exit port 137 comprises a gap 147 between the outer end portion 122 of the primary ground flange 121 and the outer end portion 129 of the secondary ground flange 127 that forms a passageway 183 therebetween.

In general, the invention disclosed in FIGS. 19-22 includes means for providing a drainage path for moisture vapor located in the space 139 between the weather resistant barrier 141 (such as Tyvek), which is wrapped onto the backing wall 157 of the wall, and the exterior cladding 143 of the wall to drain or flow from between the weather resistant barrier 141 (such as Tyvek) and the exterior cladding 143 to outside the exterior wall away from the building, and for providing ventilation to the space 139 between the weather resistant barrier 141 (such as Tyvek) and the exterior cladding 143. In the embodiment of the invention shown in FIGS. 19-22, such means comprises the recess 148 leading to the opening(s) 131, the opening(s) 131 formed in and extending through the secondary ground flange 127, the interior of the chamber 133, and the gap 147 between the outer end portion 122 of the primary ground flange 121 and the outer end portion 129 of the secondary ground flange 127.

The retaining flange 123 protects the opening(s) 131 from being blocked or clogged by the exterior cladding 143 (e.g., stucco) since the exterior cladding 143 (e.g., stucco) is positioned adjacent to the outside surface 126 of the retaining flange 123. The recess 148 between the retaining flange 123 and the vertical attachment flange 113 is designed to hold the upper end portion of a drainage mat 161. Also, since the exterior cladding 143 (e.g., stucco) is positioned adjacent to the outside surface 126 of the retaining flange 123, the space 139 between the weather resistant barrier 141 (such as Tyvek), which is wrapped onto the backing wall 157, and the exterior cladding 143 extends downwardly from the recess 148. This space 139 may be empty, but preferably contains a porous drainage mat 161. Preferably, a stop gauge 179 is provided on the secondary ground flange 127 and extends along its length to mark how far the exterior cladding (e.g., stucco) extends to.

Preferably, a strip of removable tape 181 is applied to and extends between the outer end portion 129 of the secondary ground flange 127 and the outer end portion 122 of the primary ground flange 121 to cover the gap 147 to prevent dirt, stucco, plaster, and the like from entering the gap 147 during installation of the exterior cladding 143. After installation of the exterior cladding 143, the tape 181 may be peeled from the outer end portions 129 and 122 to uncover the gap 147 and open the passageway 183 between the outer end portions 129 and 122.

The invention also includes a wall 155 having the inventive weep screed 111 mounted thereon as shown in FIGS. 21 and 22. Preferably, the wall 155 has a backing wall 157 (e.g., plywood sheeting), a weep screed 111 mounted on the backing wall 157 at the top portion of the wall 155, a weather resistant barrier 141 (which also is known as a water resistant barrier or WRB or a vapor barrier) positioned over the backing wall 157, a drainage mat 161 positioned against the weather resistant barrier 141 including a portion 162 of the drainage mat 161 that is received in the recess 148 between the vertical attachment flange 113 and the retaining flange 123, and exterior cladding 143 positioned over the drainage mat 161 below the lower end of the retaining flange 123 and over the outside surface 126 of the retaining flange 123.

Illustrative examples of the exterior cladding 143 include stucco, fiber cement siding, cultured stone, veneer stone, brick veneer, wood siding, or vinyl siding.

FIGS. 21 and 22 show an illustrative example of the inventive wall 155, in which the exterior cladding 143 comprises a stucco structure 143'. As may be seen in FIG. 22, the construction of the stucco structure 143' usually occurs in layers. A wire mesh layer 165 of galvanized wire is usually anchored to the backing wall 157 over the outside surface 167 of the drainage mat 161. Scratch coats 169 of plaster or stucco and finish coats 171 of plaster or stucco are then usually applied to the wire mesh layer 165.

End caps may be provided to be mounted at the side ends of the inventive weep screed to cap the ends of the inventive weep screed. FIGS. 23-26 illustrates such an end cap 91 that may be used in conjunction with weep screed 11.

In accordance with the invention, an inventive method is provided for removing moisture located in the space 39 between the weather resistant barrier 41 (such as Tyvek), which is wrapped onto the backing wall 57 of an exterior wall of a building, and exterior cladding 43 of the exterior wall of the building, and for providing ventilation to the space 39 between the weather resistant barrier 41 (such as Tyvek) and the exterior cladding 43. The method includes the steps of providing a wall, such as wall 55 described above, having a weep screed 11, 11A, or 11B mounted thereon, permitting moisture located between the weather resistant barrier 41 (such as Tyvek) and the exterior cladding 43 to drain from the space 39 between the weather resistant barrier 41 (such as Tyvek) and the exterior cladding 43 by moving through the opening(s) 31 formed in and extending through the primary ground flange 21 and into the chamber 33 and then from the chamber 33 through the opening(s) 45 to the exterior of the wall and the building, and providing ventilation to the space 39 between the weather resistant barrier 41 (such as Tyvek) and the exterior cladding 43 by allowing air to move into and from the space 39 between the weather resistant barrier 41 (such as Tyvek) and the exterior cladding 43 via a path defined by the opening(s) 45 and/or the gap 47, the chamber 33, and the opening(s) 31.

Also, in accordance with the invention, an inventive method is provided for removing moisture located in the space 39 between the weather resistant barrier 41 (such as Tyvek), which is wrapped onto the backing wall 57 of an exterior wall of a building, and exterior cladding 43 of the exterior wall of the building, and for providing ventilation to the space 39 between the weather resistant barrier 41 (such as Tyvek) and the exterior cladding 43. The method includes the steps of providing a wall, such as walls 55' or 55" described above, having a weep screed 11C, 11D, 11E, or 11F mounted thereon, permitting moisture located between the weather resistant barrier 41 (such as Tyvek) and the exterior cladding 43 to drain from the space 39 between the weather resistant barrier 41 (such as Tyvek) and the exterior cladding 43 by moving through the opening(s) 31 formed in and extending through the primary ground flange 21 and into the chamber 33 and then from the chamber 33 through the gap 47 to the exterior of the wall and the building, and providing ventilation to the space 39 between the weather resistant barrier 41 (such as Tyvek) and the exterior cladding 43 by allowing air to move into and from the space 39 between the weather resistant barrier 41 (such as Tyvek) and the exterior cladding 43 via a path defined by the gap 47, the chamber 33, and the opening(s) 31.

Further, in accordance with the invention, an inventive method is provided for removing moisture vapor located in the space 139 between the weather resistant barrier 141 (such as Tyvek), which is wrapped onto the backing wall 157 of an exterior wall of a building, and the exterior cladding 143 of the exterior wall of the building, and for providing ventilation to the space 139 between the weather resistant barrier 141 (such as Tyvek) and the exterior cladding 143. The method includes the steps of providing a wall, such as wall 155 described above, having a weep screed 111 mounted thereon, permitting moisture vapor located between the weather resistant barrier 141 (such as Tyvek) and the exterior cladding 143 to drain or flow from the space 139 between the weather resistant barrier 141 (such as Tyvek) and the exterior cladding 143 by moving through the opening(s) 131 formed in and extending through the secondary ground flange 127 and into the chamber 133 and then from the chamber 133 through the gap 147 to the exterior of the wall and the building, and providing ventilation to the space 139 between the weather resistant barrier 141 (such as Tyvek) and the exterior cladding 143 by allowing air to move into and from the space 139 between the weather resistant barrier 141 (such as Tyvek) and the exterior cladding 143 via a path defined by the gap 147, the chamber 133, and the opening(s) 131.

Preferably, the weep screeds 11, 11A, 11B, 11C, 11D, 11E, 11F, and 111 are comprised of a material such as a plastic or a polymer, such as exterior grade vinyl, and preferably are formed using an extrusion process. However, other suitable material, such as metals, may be used to form the weep screeds 11, 11A, 11B, 11C, 11D, 11E, 11F, and 111 from.

The preferred dimensions of the weep screeds 11, 11A, 11B, 11C, 11D, 11E, 11F, and 111 are set out in the drawings. However, other dimensions may be used. The weep screeds 11, 11A, 11B, 11C, 11D, 11E, 11F, and 111 maybe made to have any length suitable for use on an exterior wall of a building. Preferably, the inventive weep screeds 11, 11A, 11B, 11C, 11D, 11E, 11F, and 111 are prefabricated in set lengths (preferably in lengths of 10 to 12 feet, and more preferably in lengths of 10 feet) and may be cut to fit the exterior wall on which the weep screed 11, 11A, 11B, 11C, 11D, 11E, 11F, and 111 is to be applied. Also, two or more inventive weep screeds may be used adjoining one another on an exterior wall when the area requiring the application of weep screed is longer than the prefabricated lengths of inventive weep screed.

The inventive convection weep screed 11, 11A, 11B, 11C, 11D, 11E, 11F, and 111 provide a capillary break between the framing (e.g., plywood backing wall) of a building and the exterior cladding (e.g., masonry siding like stucco), a water drainage mechanism for draining water that penetrates into an exterior wall of a building, and an air cavity in the exterior wall that aids drainage of water that penetrates into an exterior wall and that aids ventilation of the interior of the exterior wall which helps the wall dry after being penetrated by water.

The invention provides a pathway to the space between the weather resistant barrier (such as Tyvek), which is wrapped onto the backing wall, and the exterior cladding to permit water/moisture/moisture vapor that collects there to drain therefrom and to permit air to gain access to said space, thereby providing an uninterrupted pathway for air to ventilate and dry said space.

What is claimed is:

1. A weep screed, comprising a vertical attachment flange having an upper end and a lower end, a primary ground flange extending outwardly at an obtuse angle from the vertical attachment flange, the primary ground flange having a downwardly extending outer end portion forming a drip line, a secondary ground flange extending outwardly at an obtuse angle from the vertical attachment flange, the secondary ground flange having an outer end portion, and the secondary ground flange being positioned on the vertical attachment flange between the primary ground flange and the lower end of the vertical attachment flange, a retaining flange formed on the primary ground flange, the retaining flange extending upwardly and in a plane substantially parallel to the vertical attachment flange, the retaining flange having an inside surface that faces the vertical attachment flange, and the retaining flange having an outside surface that faces away from the vertical attachment flange, the primary ground flange having at least one opening formed therein and extending therethrough, the at least one opening formed in the primary ground flange being located in a portion of the primary ground flange between the vertical attachment flange and the retaining flange, and a chamber defined by the primary ground flange, the secondary ground flange, and a portion of the vertical attachment flange extending between the primary ground flange and the secondary ground flange, the chamber having at least one entrance/exit port formed in and extending through the outer end portion of the secondary ground flange and/or between the outer end portion of the primary ground flange and the outer end portion of the secondary ground flange, and a recess comprising the entire space surrounded by the primary ground flange, the vertical attachment flange, and the retaining flange for communicating directly with space between a weather resistant barrier positioned on a backing wall of an exterior wall and exterior cladding of the exterior wall when the weep screed is in use on the exterior wall for permitting moisture located between the weather resistant barrier and the exterior cladding to drain from the space between the weather resistant barrier and the exterior cladding into and through said recess, from which said moisture may move into and through the at least one opening formed in the primary ground flange, then into and through the chamber, and then into and through at least one entrance/exit port to outside the exterior wall, and for providing ventilation to the space between the weather resistant barrier and the exterior cladding via air from said recess, said air moving into said recess by moving from outside the exterior wall into and through the at least one entrance/exit port, then into and through the chamber, and then into and through the at least one opening formed in the primary ground flange to said recess, said recess when the weep screed is in use on the exterior wall either being completely empty other than for moisture or air but permitting moisture and air to pass through it, or being completely empty other than for a porous drainage mat and/or starter strips, together with moisture or air but permitting moisture and air to pass through it.

2. The weep screed of claim 1, the at least one entrance/exit port comprising at least one opening formed in and extending through the secondary ground flange, the at least one opening being located in the outer end portion of the secondary ground flange.

3. The weep screed of claim 1, the at least one entrance/exit port comprising a gap between the outer end portion of the primary ground flange and the outer end portion of the secondary ground flange.

4. The weep screed of claim 1, further including a primary support flange for supporting a starter strip and/or a drainage mat extending across the inside surface of the retaining flange.

5. The weep screed of claim 1, further including a secondary support flange for supporting a starter strip and/or a drainage mat extending across the length of the vertical attachment flange above the primary ground flange where the vertical attachment flange and the primary ground flange meet.

6. The weep screed of claim 1, further including a first groove formed along the length of the vertical attachment flange in a portion of the vertical attachment flange below the secondary ground flange, the first groove having sufficient depth for permitting the portion of the vertical attachment flange located below the first groove to be broken off along the first groove.

7. The weep screed of claim 6, further including at least one additional groove formed along the length of the vertical attachment flange in a portion of the vertical attachment flange below the first groove, the at least one additional groove having sufficient depth for permitting the portion of the vertical attachment flange located below the at least one additional groove to be broken off along the at last one additional groove.

8. The weep screed of claim 1, the downwardly extending end portion of the primary ground flange extending lower than the secondary ground flange, the downwardly extending end portion of the primary ground flange having an end portion that extends downwardly in an inward direction, and the end portion of the downwardly extending end portion of the primary ground flange having a free end, the free end extending lower than any other portion of the primary ground flange.

9. A wall, comprising a backing wall, a weather resistant barrier positioned on the backing wall, the weep screed of claim 1 mounted on the backing wall through the weather resistant barrier, and exterior cladding positioned on the wall adjacent to the outside surface of the retaining flange, the space between the weather resistant barrier and the exterior cladding extending upwardly from and being in fluid communication with the recess defined by the vertical attachment flange, the primary ground flange, and the retaining flange, the space between the weather resistant barrier and the exterior cladding either being completely empty other than for moisture or air or containing, other than moisture or air, only a porous drainage mat and/or starter strips.

10. A method of removing moisture located in space between a weather resistant barrier of a wall and exterior cladding of a wall and providing ventilation to space between the weather resistant barrier of a wall and the exterior cladding, comprising the steps of providing the wall of claim 9, permitting moisture located between the weather resistant barrier and the exterior cladding to drain from the space between the weather resistant barrier and the exterior cladding by moving through the at least one opening formed in and extending through the primary ground flange and into the chamber, and then from the chamber through the at least one entrance/exit port, and providing ventilation to the space between the weather resistant barrier and the exterior cladding by allowing air to move into and from the space between the weather resistant barrier and the exterior cladding via a path defined by the at least one entrance/exit port, the chamber, and the at least one opening formed in and extending through the primary ground flange.

11. The wall of claim 9, further including a porous drainage mat positioned in the recess defined by the vertical attachment flange, the primary ground flange, and the retaining flange and in the space between the weather resistant barrier and the exterior cladding.

12. The weep screed of claim 1, the at least one entrance/exit port being formed between the outer end portion of the primary ground flange and the outer end portion of the secondary ground flange, and the downwardly extending outer end portion of the primary ground flange extending lower than the secondary ground.

13. The weep screed of claim 12, the secondary ground flange having an upwardly extending end portion that is shielded by the downwardly extending lower end portion of the primary ground flange.

14. The weep screed of claim 12, the secondary ground flange having an outer end portion that is co-planar with all of the secondary ground flange and that is shielded by the downwardly extending outer end portion of the primary ground flange.

15. The weep screed of claim 12, the secondary ground flange having a downwardly extending end portion that is shielded by the downwardly extending outer end portion of the primary ground flange.

16. In a wall having a backing wall, a weather resistant barrier positioned on the backing wall, and an exterior cladding, a weep screed for mounting on the wall, comprising a vertical attachment flange having an upper end and a lower end, a primary ground flange extending outwardly at an obtuse angle from the vertical attachment flange, the primary ground flange having a downwardly extending outer end portion forming a drip line, a secondary ground flange extending outwardly at an obtuse angle from the vertical attachment flange, the secondary ground flange having an outer end portion, and the secondary ground flange being positioned on the vertical attachment flange between the primary ground flange and the lower end of the vertical attachment flange, a retaining flange formed on the primary ground flange, the retaining flange extending upwardly and in a plane substantially parallel to the vertical attachment flange, the retaining flange having an inside surface that faces the vertical attachment flange, and the retaining flange having an outside surface that faces away from the vertical attachment flange, and pathway means for providing a drainage path for moisture located between a weather resistant barrier positioned on a backing wall of the exterior wall and exterior cladding of the exterior wall to drain from between the weather resistant barrier and the exterior cladding to outside the exterior wall away from the building and for providing ventilation to space between the weather resistant barrier and the exterior cladding, when the weep screed is mounted on an exterior wall of a building, said pathway means including a recess comprising the entire space surrounded by the primary ground flange, the vertical attachment flange, and the retaining flange for communicating directly with space between a weather resistant barrier positioned on a backing wall of an exterior wall and exterior cladding of the exterior wall when the weep screed is in use on the exterior wall for permitting moisture located in the space between the weather resistant barrier and the exterior cladding to drain from the space between the weather resistant barrier and the exterior cladding into and through said recess, and for providing ventilation to the space between the weather resistant barrier and the exterior cladding via air from said recess, and said recess when the weep screed is in use on the exterior wall either being completely empty other than for moisture or air but permitting moisture and air to pass through it, or being completely empty other than for a porous drainage mat and/or starter strips, together with moisture or air but permitting moisture and air to pass through it.

17. The weep screed of claim 16, said pathway means including the primary ground flange having at least one opening formed therein and extending therethrough, the at least one opening being located in a portion of the primary ground flange between the vertical attachment flange and the retaining flange.

18. The weep screed of claim 16, said pathway means including at least one entrance/exit port comprising at least one opening formed in and extending through the secondary ground flange, the at least one opening being located in the outer end portion of the secondary ground flange.

19. The weep screed of claim 16, said pathway means including a gap between the outer end portion of the primary ground flange and the outer end portion of the secondary ground flange.

20. A wall, comprising a backing well, a weather resistant barrier positioned on the backing wall, the weep screed of claim 16 mounted on the backing wall through the weather resistant barrier, and exterior cladding positioned on the wall adjacent to the outside surface of the retaining flange, the recess of the pathway means of the weep screed either being completely empty other than for moisture or air but permitting moisture and air to pass through it, or being completely empty other than for a porous drainage mat and/or starter strips, together with moisture or air but permitting moisture and air to pass through it.

21. A weep screed for mounting on an exterior wall of a building, comprising a vertical attachment flange having an upper end and a lower end, a primary flange extending outwardly from the vertical attachment flange, the primary flange having a downwardly extending outer end portion forming a drip line, a secondary flange extending outwardly from the vertical attachment flange, the secondary flange having an outer end portion, and the secondary flange being positioned on the vertical attachment flange between the primary flange and the lower end of the vertical attachment flange, a retaining flange formed on the primary ground flange, the retaining flange extending upwardly and in a plane substantially parallel to the vertical attachment flange, the retaining flange having an inside surface that faces the vertical attachment flange, and the retaining flange having an outside surface that faces away from the vertical attachment flange, and pathway means for providing a drainage path for moisture vapor located between a weather resistant barrier positioned on a backing wall of the exterior wall and exterior cladding of the exterior wall to drain from between the weather resistant barrier and the exterior cladding to outside the exterior wall away from the building and for providing ventilation to space between the weather resistant barrier and the exterior cladding, when the weep screed is mounted on an exterior wall of a building, said pathway means including a recess comprising the entire space surrounded by the primary ground flange, the vertical attachment flange, and the retaining flange for communicating directly with space between a weather resistant barrier positioned on a backing wall of an exterior wall and exterior cladding of the exterior wall when the weep screed is in use on the exterior wall for permitting moisture located in the space between the weather resistant barrier and the exterior cladding to drain from the space between the weather resistant barrier and the exterior cladding into and through said recess, and for providing ventilation to the space between the weather resistant barrier and the exterior cladding via air from said recess, and said recess when the weep screed is in use on the exterior wall either being completely empty other than for moisture or air but permitting moisture and air to pass through it, or being completely empty other than for a porous drainage mat and/or starter strips, together with moisture or air but permitting moisture and air to pass through it.

22. The weep screed of claim 21, said pathway means including the secondary flange having at least one opening formed therein and extending therethrough.

23. The weep screed of claim 21, said means including a gap between the outer end portion of the primary flange and the outer end portion of the secondary flange.

24. A weep screed, comprising a vertical attachment flange having an upper end and a lower end, a primary flange extending outwardly from the vertical attachment flange, the primary flange having a downwardly extending outer end portion forming a drip line, a secondary flange extending outwardly from the vertical attachment flange, the secondary flange having an outer end portion, and the secondary flange being positioned on the vertical attachment flange between the primary flange and the lower end of the vertical attachment flange, a retaining flange formed on the secondary flange, the entire retaining flange extending downwardly and in a plane substantially parallel to the vertical attachment flange, the retaining flange having an inside surface that faces the vertical attachment flange, and the retaining flange having an outside surface that faces away from the vertical attachment flange, the secondary flange having at least one opening formed therein and extending therethrough, the at least one opening formed in the secondary ground flange being located in a portion of the secondary ground flange between the vertical attachment flange and the retaining flange, and a chamber defined by the primary flange, the secondary flange, and a portion of the vertical attachment flange extending between the primary flange and the secondary flange, the chamber having at least one entrance/exit port formed between the outer end portion of the primary flange and the outer end portion of the secondary flange.

25. The weep screed of claim 24, the at least one entrance/exit port comprising a gap between the outer end portion of the primary flange and the outer end portion of the secondary flange.

26. A wall, comprising a backing wall, a weather resistant barrier positioned on the backing wall, the weep screed of claim 25 mounted on the backing wall through the weather resistant barrier, and exterior cladding positioned on the wall adjacent to the outside surface of the retaining flange.

27. A wall, comprising a backing wall, a weather resistant barrier positioned on the backing wall, the weep screed of claim 24 mounted on the backing wall through the weather resistant barrier, and exterior cladding positioned on the wall adjacent to the outside surface of the retaining flange.

28. A method of removing moisture located in space between a weather resistant barrier of a wall and exterior cladding of a wall and providing ventilation to space between the weather resistant barrier of a wall and the exterior cladding, comprising the steps of providing the wall of claim 27, the wall including a weather resistant barrier positioned on the backing wall, permitting moisture vapor located between the weather resistant barrier and the exterior cladding to exit from the space between the weather resistant barrier and the exterior cladding by moving through the at least one opening formed in and extending through the secondary flange and into the chamber, and then from the chamber through the at least one entrance/exit port, and providing ventilation to the space between the weather resistant barrier and the exterior cladding by allowing air to move into and from the space between the weather resistant barrier and the exterior cladding via a path defined by the at least one entrance/exit port, the chamber, and the at least one opening formed in and extending through the secondary flange.

29. The weep screed of claim 24, the at least one entrance/exit port being formed between the outer end portion of the primary ground flange and the outer end portion of the secondary ground flange, the downwardly extending outer end portion of the primary ground flange extending lower than the secondary ground, and the secondary ground flange having an upwardly extending end portion that is shielded by the downwardly extending lower end portion of the primary ground flange.

* * * * *